US009301576B2

(12) United States Patent
Miller et al.

(10) Patent No.: US 9,301,576 B2
(45) Date of Patent: Apr. 5, 2016

(54) METHOD OF PRINTING ONTO AN ARTICLE

(71) Applicant: Nike, Inc., Beaverton, OR (US)

(72) Inventors: Todd W. Miller, Portland, OR (US); Eli R. Troyke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 497 days.

(21) Appl. No.: 13/868,132

(22) Filed: Apr. 23, 2013

(65) Prior Publication Data

US 2014/0310892 A1 Oct. 23, 2014

(51) Int. Cl.

| | |
|---|---|
| ***B41J 3/407*** | (2006.01) |
| ***A43D 8/22*** | (2006.01) |
| ***A43D 95/14*** | (2006.01) |
| ***B41M 5/00*** | (2006.01) |
| ***B41J 2/01*** | (2006.01) |
| ***A43B 3/00*** | (2006.01) |
| ***A43D 3/02*** | (2006.01) |

(52) U.S. Cl.

CPC ..... *A43D 8/22* (2013.01); *A43B 3/0078* (2013.01); *A43B 3/0084* (2013.01); *A43D 3/022* (2013.01); *A43D 3/023* (2013.01); *A43D 3/025* (2013.01); *A43D 3/029* (2013.01); *A43D 95/14* (2013.01); *B41J 2/01* (2013.01); *B41J 3/4073* (2013.01); *B41M 5/0047* (2013.01); *B41M 5/0052* (2013.01); *B41M 5/0064* (2013.01); *B41M 5/0076* (2013.01)

(58) Field of Classification Search

CPC ..... A43D 3/04; A43D 8/22; A43D 8/24; A43D 95/14; B41J 3/4073; B41F 17/001; B41F 17/002; B41F 17/18; B41F 17/24; B41M 5/0041; B41M 5/0047; B41M 5/0052; B41M 5/0076; B41M 5/0064; B29C 33/3821

See application file for complete search history.

(56) References Cited

U.S. PATENT DOCUMENTS

| | | | | |
|---|---|---|---|---|
| 1,498,400 | A | 6/1924 | Patten | |
| 1,792,192 | A * | 2/1931 | Sordelett | A43D 3/04 12/114.4 |
| 2,034,314 | A | 3/1936 | Samuel | |
| 2,264,416 | A | 12/1941 | Topham | |
| 2,472,754 | A * | 6/1949 | Mead | A63B 7/28 206/524.8 |
| 3,032,792 | A | 5/1962 | Frank | |
| 3,964,534 | A | 6/1976 | Rabinowitz | |
| 3,973,285 | A | 8/1976 | Babson et al. | |
| 4,183,156 | A | 1/1980 | Rudy | |

(Continued)

FOREIGN PATENT DOCUMENTS

| | | |
|---|---|---|
| DE | 102008030713 | 4/2009 |
| EP | 507709 | 10/1992 |

(Continued)

OTHER PUBLICATIONS

International Search Report and Written Opinion mailed Sep. 22, 2014 in PCT/US2014/034934.

(Continued)

*Primary Examiner* — Daniel J Colilla

(74) *Attorney, Agent, or Firm* — Plumsea Law Group, LLC

(57) ABSTRACT

A method of printing onto an article includes placing an article on a holding assembly, flattening a portion of the article and printing onto the flattened portion of the article. Flattening can be accomplished using a flattening plate and by controlling the shape of a surface of the holding assembly using a vacuum.

20 Claims, 27 Drawing Sheets

(56) References Cited

U.S. PATENT DOCUMENTS

| | | | | |
|---|---|---|---|---|
| 4,219,945 | A | 9/1980 | Rudy | |
| 4,627,124 | A | 12/1986 | Winter | |
| 4,661,198 | A | 4/1987 | Simmonds, Jr. et al. | |
| 4,936,029 | A | 6/1990 | Rudy | |
| 5,042,176 | A | 8/1991 | Rudy | |
| 5,090,320 | A | 2/1992 | Nave | |
| 5,341,532 | A | 8/1994 | Markowitz | |
| 5,713,141 | A | 2/1998 | Mitchell et al. | |
| 5,832,819 | A * | 11/1998 | Widman | B41M 5/0256 101/33 |
| 5,952,065 | A | 9/1999 | Mitchell et al. | |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,266,837 | B1 | 7/2001 | Nord | |
| 6,321,465 | B1 | 11/2001 | Bonk et al. | |
| 6,782,640 | B2 | 8/2004 | Westin | |
| 2002/0023306 | A1 | 2/2002 | Sajedi et al. | |
| 2002/0191036 | A1 * | 12/2002 | Park | B41J 3/4073 347/4 |
| 2004/0163978 | A1 * | 8/2004 | Davidson | B41J 3/4073 206/315.3 |
| 2009/0119950 | A1 | 5/2009 | Kohatsu et al. | |
| 2011/0109686 | A1 | 5/2011 | McDowell et al. | |
| 2011/0277250 | A1 | 11/2011 | Langvin et al. | |
| 2015/0202453 | A1 * | 7/2015 | Topp | A61N 2/006 600/13 |

FOREIGN PATENT DOCUMENTS

| | | | |
|---|---|---|---|
| FR | 14 612 | E | 1/1912 |
| FR | 2 555 038 | A1 | 5/1985 |
| JP | 62259854 | | 11/1987 |
| JP | 2002103437 | | 4/2002 |
| WO | 99/56578 | A1 | 11/1999 |
| WO | 2010/039826 | A2 | 4/2010 |

OTHER PUBLICATIONS

International Search Report and Written Opinion mailed Oct. 2, 2014 in PCT/US2014/034945.

International Search Report and Written Opinion mailed Sep. 22, 2014 in PCT/US2014/034965.

International Preliminary Report on Patentability and Written Opinion of the International Searching Authority issued Nov. 5, 2015 in International Patent Application No. PCT/US2014/034965.

International Preliminary Report on Patentability and Written Opinion of the International Searching Authority issued Nov. 5, 2015 in International Patent Application No. PCT/US2014/034945.

International Preliminary Report on Patentability and Written Opinion of the International Searching Authority issued Nov. 5, 2015 in International Patent Application No. PCT/US2014/034934.

* cited by examiner

METHOD OF PRINTING ONTO AN ARTICLE

RELATED APPLICATIONS

This application is related to the following commonly owned copending applications: U.S. Patent Application Publication Number 2014/0310891, published on Oct. 23, 2014, titled "Holding Assembly for Articles" and U.S. Patent Application Publication Number 2014/0310890, published on Oct. 23, 2014, titled "Holding Assembly with Locking System for Articles," which are all herein incorporated by reference in their entirety.

BACKGROUND

The present embodiments relate generally to articles of footwear and in particular to a flexible manufacturing system for an article of footwear.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot.

The sole structure is secured to a lower portion of the upper so as to be positioned between the foot and the ground. In athletic footwear, for example, the sole structure may include a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

Articles can be manufactured with a variety of designs. Various kinds of graphics can be applied to an article using, for example, printing techniques.

SUMMARY

In another aspect, a method of printing to an upper of an article of footwear includes placing the article of footwear onto a last portion of a holding assembly, the last portion including a first side portion filled with a plurality of bead members and further having a flexible membrane stretched over the plurality of bead members. The method also includes flattening a side portion of the upper and the first side portion of the last portion. The method also includes creating a vacuum within an interior cavity of the first side portion so that the flexible membrane and the plurality of bead members have a substantially rigid geometry and printing onto the side portion of the upper.

In another aspect, a method of printing to an upper of an article of footwear includes placing the article of footwear onto a last portion of a holding assembly, the last portion including a first side portion and a second side portion connected via a bladder member. The method also includes inflating the bladder member so that the last portion expands and causes the article of footwear to tilt on the last portion, flattening a side portion of the upper and printing onto the side portion of the upper.

In another aspect, a method of printing to an upper of an article of footwear includes placing the article of footwear onto a last portion of a holding assembly, the last portion including a first side portion with an outer surface that is substantially deformable and the last portion including a second side portion. The method also includes placing the holding assembly with the article of footwear on a platform. The method also includes fastening a flattening plate to a plurality of mounting arms such that the flattening plate contacts the article of footwear. The method also includes repositioning the upper on the last portion so that the contact area between the flattening plate and the upper increases. The method also includes temporarily increasing the rigidity of the outer surface of the first side portion. The method also includes removing the flattening plate and printing onto the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
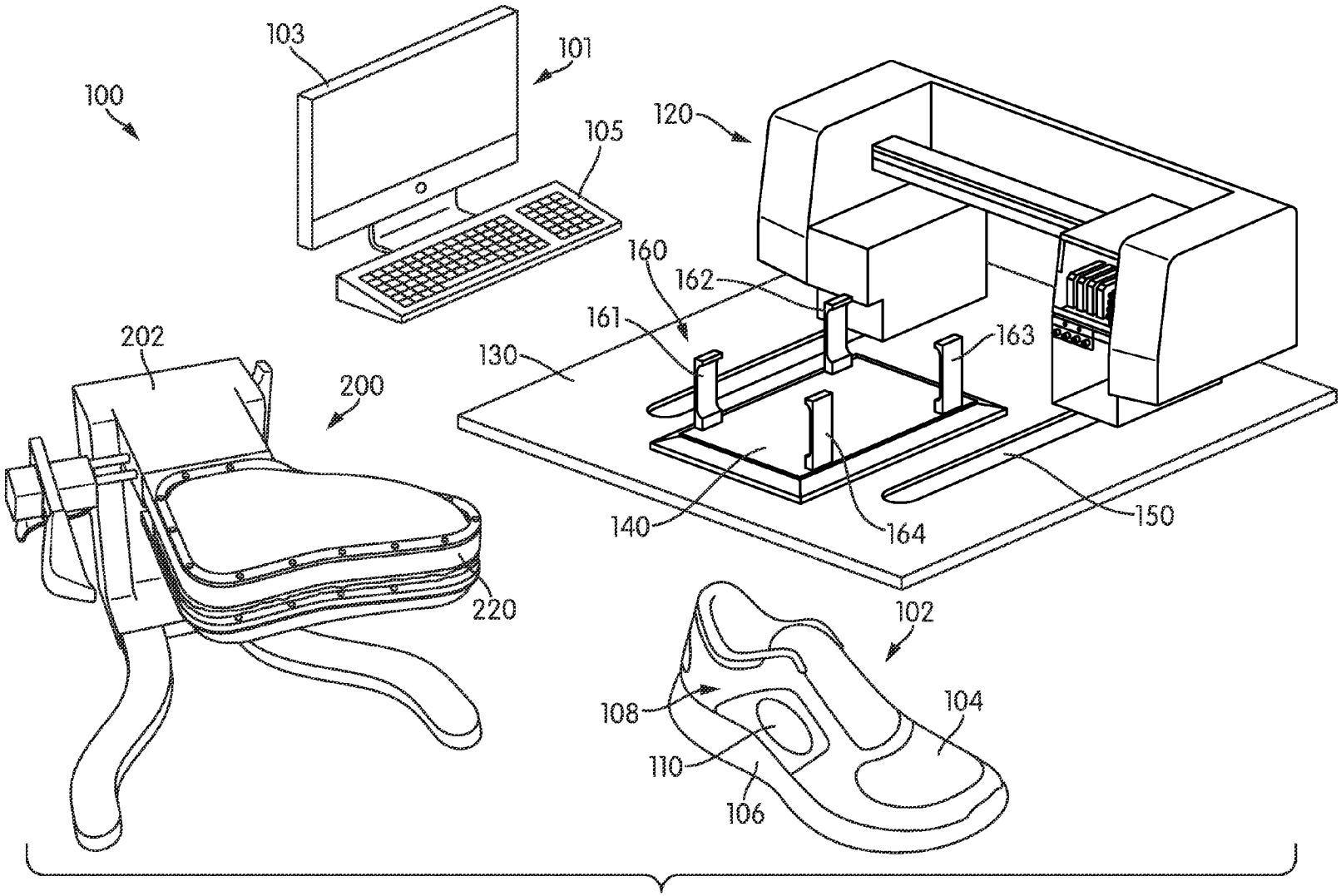
FIG. 1 is a schematic view of various components of an embodiment of a flexible manufacturing system.

FIG. 1 is a schematic view of an embodiment of flexible manufacturing system 100. In some embodiments, flexible manufacturing system 100 may be intended for use with various kinds of articles including footwear and/or apparel. In particular, flexible manufacturing system 100 may include various kinds of provisions for applying graphics, or any type of design or image, to footwear and/or apparel. Moreover, the process of applying graphics may occur during manufacturing of an article and/or after an article has been manufactured. In some embodiments, graphics may be applied to an article of footwear after the article of footwear has been manufactured into a three-dimensional form including an upper and sole structure. In some embodiments, a flexible manufacturing system could be used at a retail location to apply user selected graphics to articles of footwear and/or articles of apparel.

The term "graphic" as used throughout this detailed description and in the claims refers to any visual design elements including, but not limited to: photos, logos, text, illustrations, lines, shapes, patterns, images of various kinds as well as any combinations of these elements. Moreover, the term graphic is not intended to be limiting and could incorporate any number of contiguous or non-contiguous visual features. For example, in one embodiment, a graphic may comprise a logo that is applied to a small region of an article of footwear. In another embodiment, a graphic may comprise a large region of color that is applied over one or more regions, including the entirety, of an article of footwear.

For clarity, the following detailed description discusses an exemplary embodiment, in which flexible manufacturing system 100 is used to apply graphics to article of footwear 102. In this case, article of footwear 102, or simply article 102, may take the form of an athletic shoe, such as a running shoe. However, it should be noted that in other embodiments flexible manufacturing system 100 may be used with any other kinds footwear including, but not limited to: hiking boots, soccer shoes, football shoes, sneakers, rugby shoes, basketball shoes, baseball shoes as well as other kinds of shoes. While FIG. 1 shows a single article, it will be understood that flexible manufacturing system 100 could be used to apply graphics to two or more articles, including articles that make up a pair of footwear.

In some embodiments, article 102 may include upper 104 and sole structure 106. Generally, upper 104 may be any type of upper. In particular, upper 104 may have any design, shape, size and/or color. For example, in embodiments where article 102 is a basketball shoe, upper 104 could be a high top upper that is shaped to provide high support on an ankle. In embodiments where article 102 is a running shoe, upper 104 could be a low top upper.

As seen in FIG. 1, upper 104 generally has a contoured shape that approximates the shape of the foot. For example, lateral side portion 108 of upper 104 may be generally contoured, rather than substantially flat. Moreover, it will be understood that the shape of lateral side portion 108, as well as any other portion of upper 104, could vary in any other manner from one embodiment to another. In particular, the principles described here for applying graphics to an article of footwear are not limited to articles with any predetermined geometry and/or shape.

In some embodiments, upper 104 may be configured with one or more design elements. For example, upper 104 may include design element 110, which is disposed on lateral side portion 108. In the current embodiment, design element 110 takes the form of an oval-like design on upper 104. However, in other embodiments, design element 110 could be configured as any kind of indicia, graphic or other design feature. Examples of various design elements that could be incorporated into upper 104 include, but are not limited to: logos, numbers, letters, various kinds of graphics, trim elements as well as other kinds of design elements. Moreover, in some embodiments, a design element may be applied to upper 104 using inks, for example using a printer. In other embodiments, a design element could comprise a separate material layer that is attached to a base layer of upper 104.

Flexible manufacturing system 100 need not be limited to use with articles of footwear and the principles taught throughout this detailed description may be applied to additional articles as well. Examples of articles that could be used with a flexible manufacturing system include, but are not limited to: footwear, gloves, shirts, pants, socks, scarves, hats, jackets, as well as other articles. Other examples of articles include, but are not limited to: shin guards, knee pads, elbow pads, shoulder pads, as well as any other type of protective equipment and/or sporting equipment. Additionally, in some embodiments, the article could be another type of article, including, but not limited to: balls, bags, purses, backpacks, as well as other articles that may not be worn.

Flexible manufacturing system 100 may comprise various provisions that are useful in applying a graphic directly to an article. In some embodiments, flexible manufacturing system 100 may include printing system 120. Printing system 120 may comprise one or more individual printers. Although a single printer is illustrated in FIG. 1, other embodiments could incorporate two or more printers that may be networked together.

Printing system 120 may utilize various types of printing techniques. These can include, but are not limited to: toner-based printing, liquid inkjet printing, solid ink printing, dye-sublimation printing, inkless printing (including thermal printing and UV printing), MEMS jet printing technologies as well as any other methods of printing. In some embodiments, printing system 120 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements.

In one embodiment, printing system 120 may utilize an inkjet printer in which ink droplets may be sprayed onto a substrate, such as the medial or lateral side panel of a formed upper. Using an inkjet printer allows for easy variation in color and ink density. This arrangement also allows for some separation between the printer head and the target object, which can facilitate printing directly to objects with some curvature and/or surface texture.

Flexible manufacturing system 100 can include provisions for facilitating the alignment of a printed graphic onto article 102. In some embodiments, it may be useful to provide a user with a way of aligning an article with a printing system so as to ensure a graphic is printed in the desired portion (i.e., location) of the article. In particular, in some embodiments, flexible manufacturing system 100 may include provisions for pre-aligning an article with a printer in such a way as to accommodate articles of various types, shapes and sizes.

Referring to FIG. 1, some embodiments of flexible manufacturing system 100 can include provisions that help to facilitate alignment of a graphic on an article. Examples of alignment systems that may be used to ensure that a graphic is printed onto the desired portion (or location) of an article are disclosed in Miller, U.S. Patent Application Publication Number 2014/0026773, published on Jan. 30, 2014, and titled "Projector Assisted Alignment and Printing," (herein referred to as "the alignment and printing case") as well as in Miller, U.S. Pat. No. 8,978,551, titled "Projection Assisted Printer Alignment Using Remote Device," (herein referred to as "the printer alignment using remote device case"), the entirety of both being herein incorporated by reference.

In one embodiment, flexible manufacturing system 100 may include base portion 130 and platform 140. Base portion 130 may comprise a substantially flat surface for mounting one or more components of flexible manufacturing system 100. In some embodiments, for example, base portion 130 may be a table-top. In some embodiments, platform 140 is disposed on base portion 130. In some embodiments, platform 140 comprises a surface that is accessible to printing system 120. In particular, articles placed on platform 140 may be printed to using printing system 120.

In some embodiments, printing system 120 may be mounted to tracks 150 of base portion 130. In some embodiments, printing system 120 is mounted in a movable manner to base portion 130, so that printing system 120 is capable of sliding along tracks 150. This allows printing system 120 to move between a first position, in which printing system 120 is disposed away from platform 140 (as shown in FIG. 1), and a second position, in which printing system 120 is disposed over platform 140 (see FIG. 32). With this arrangement, alignment of a graphic on an article may be done while printing system 120 is in the first, or inactive, position. Once the graphic alignment has been completed, printing system 120 may be moved to the second, or active, position. In this active position, printing system 120 may be disposed directly over platform 140 and may be configured to print a graphic onto an article that is disposed on platform 140.

While the current embodiment illustrates a configuration where printing system 120 moves with respect to base portion 130, while platform 140 remains stationary, other embodiments could incorporate any other methods for moving printing system 120 and platform 140 relative to one another. As an example, other embodiments could utilize a transfer system where a platform could be moved to various positions, including a position under printing system 120. An example of such a transfer system is disclosed in the alignment and printing case discussed above.

In some embodiments, flexible manufacturing system 100 may further include one or more mounting arms to facilitate the preparation of an article for printing, as discussed in further detail below. In some embodiments, flexible manufacturing system 100 can include plurality of mounting arms 160, which includes first mounting arm 161, second mounting arm 162, third mounting arm 163 and fourth mounting arm 164. Although the current embodiment illustrates four mounting arms for attaching and supporting various components of a flexible manufacturing system, other embodiments could include any other number of mounting arms as well as any other kind of mounting structures.

Provisions for aligning an article to ensure a graphic is printed on a desired region of the article can also be included. One method of alignment, which uses a display device such as a transparent LCD screen, is discussed below and shown in FIGS. 28-30. Further examples of methods of aligning an article to receive a graphic in a desired region are disclosed in the alignment and printing case.

Some embodiments may include provisions to help hold an article in place in order to facilitate alignment and printing of a graphic onto the article. In some embodiments, for example, a flexible manufacturing system can include a holding assembly, which may comprise a stand, fixture, or similar type of device that is capable of holding an article in a predetermined position and/or orientation. In one embodiment, flexible manufacturing system includes a holding assembly that acts as a fixture for an article of footwear by holding an article in place during a printing process. Additionally, as described below, the holding assembly may also include provisions to prepare a portion of an article for printing, such as provisions to flatten one or more portions of an article of footwear.

In some embodiments, flexible manufacturing system 100 may include holding assembly 200. Holding assembly 200 may further include base portion of holding assembly 202 and last portion 220. Base portion of holding assembly 202 may provide a support for last portion 220, so that last portion 220 can hold an article in a predetermined position and/or orientation. Details of holding assembly 200 are discussed in further detail below.

In some embodiments, flexible manufacturing system 100 may include computing system 101. The term "computing system" refers to the computing resources of a single computer, a portion of the computing resources of a single computer, and/or two or more computers in communication with one another. Any of these resources can be operated by one or more users. In some embodiments, computing system 101 can include user input device 105 that allow a user to interact with computing system 101. Likewise, computing system 101 may include display 103. In some embodiments, computing system 101 can include additional provisions, such as a data storage device (not shown). A data storage device could include various means for storing data including, but not limited to: magnetic, optical, magneto-optical, and/or memory, including volatile memory and non-volatile memory. These provisions for computing system 101, as well as possibly other provisions not shown or described here, allow computing system 101 to communicate with and/or control various components of flexible manufacturing system 100. For example, computing system 101 may be used to: create and/or manipulate graphics, control printing system 120, control components of an alignment system (such as an LCD screen) as well as to possibly control systems associated with holding assembly 200.

For purposes of facilitating communication between various components of flexible manufacturing system 100 (including computing system 101, printing system 120, holding assembly 200, as well as possibly other components), the components can be connected using a network of some kind. Examples of networks include, but are not limited to: local area networks (LANs), networks utilizing the Bluetooth protocol, packet switched networks (such as the Internet), various kinds of wired networks as well as any other kinds of wireless networks. In other embodiments, rather than utilizing an external network, one or more components (i.e., printing system 120) could be connected directly to computing system 101, for example, as peripheral hardware devices.

In operation, article 102 may be placed onto last portion 220 of holding assembly 200. In some embodiments, article 102 may be aligned in a predetermined position on platform 140 using, for example, an LCD screen that communicates with computing system 101. Finally, a graphic may be printed onto a portion of article 102 using printing system 120. The details of this operation are discussed in further detail below.

Figure 2:
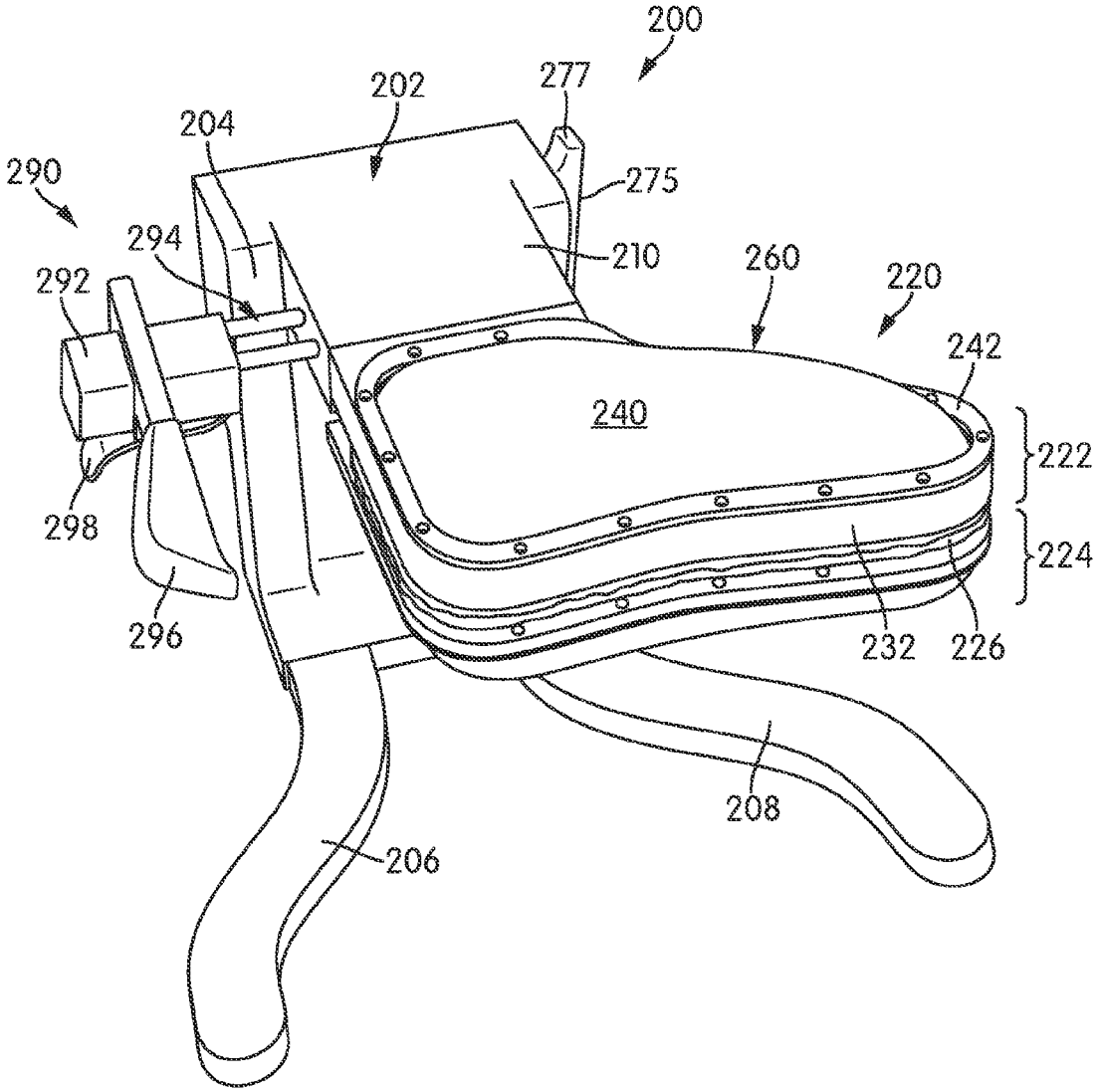
FIG. 2 is an isometric view of an embodiment of a holding assembly.
Figure 3:
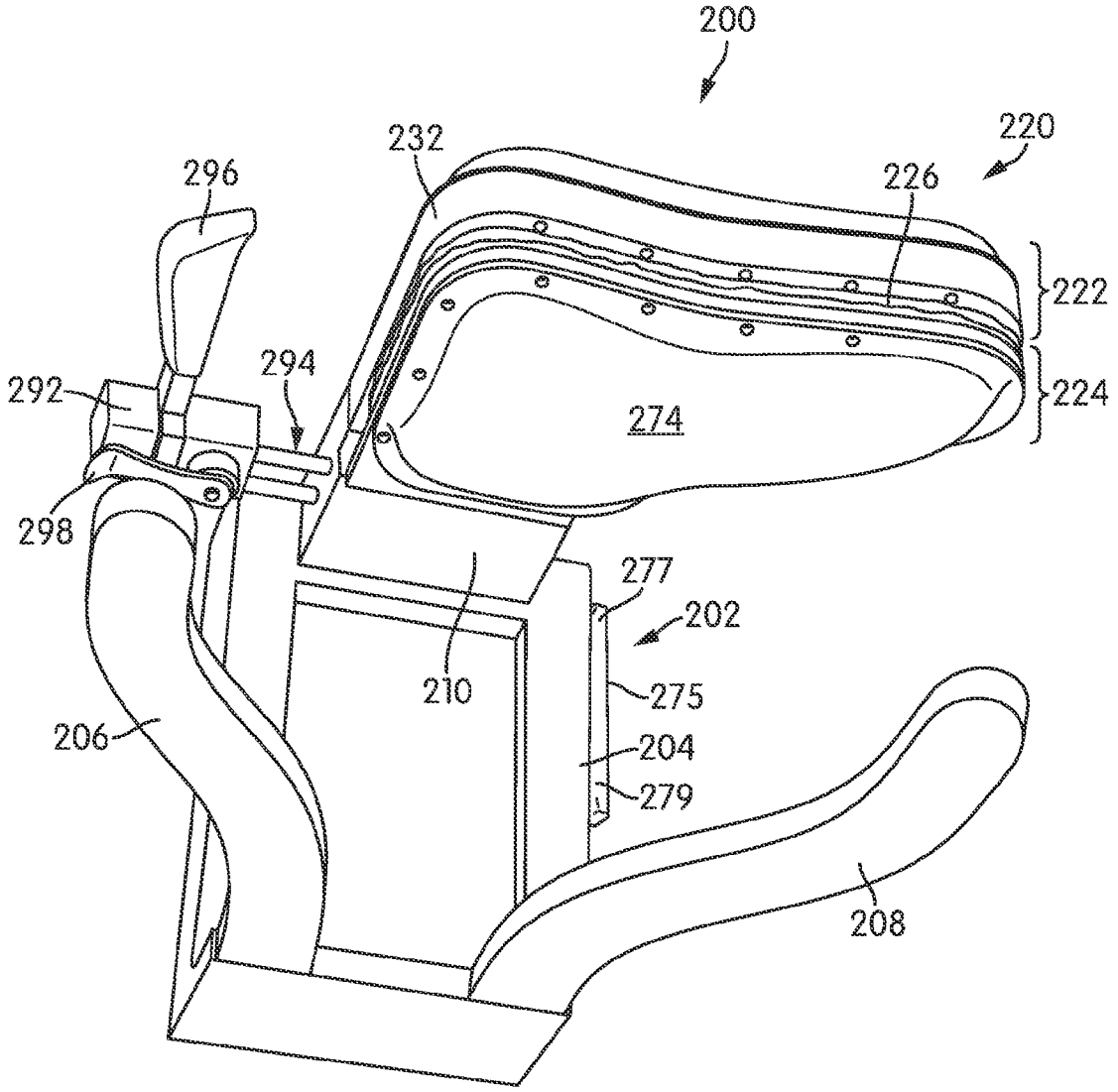
FIG. 3 is a bottom up isometric view of an embodiment of a holding assembly.
Figure 4:
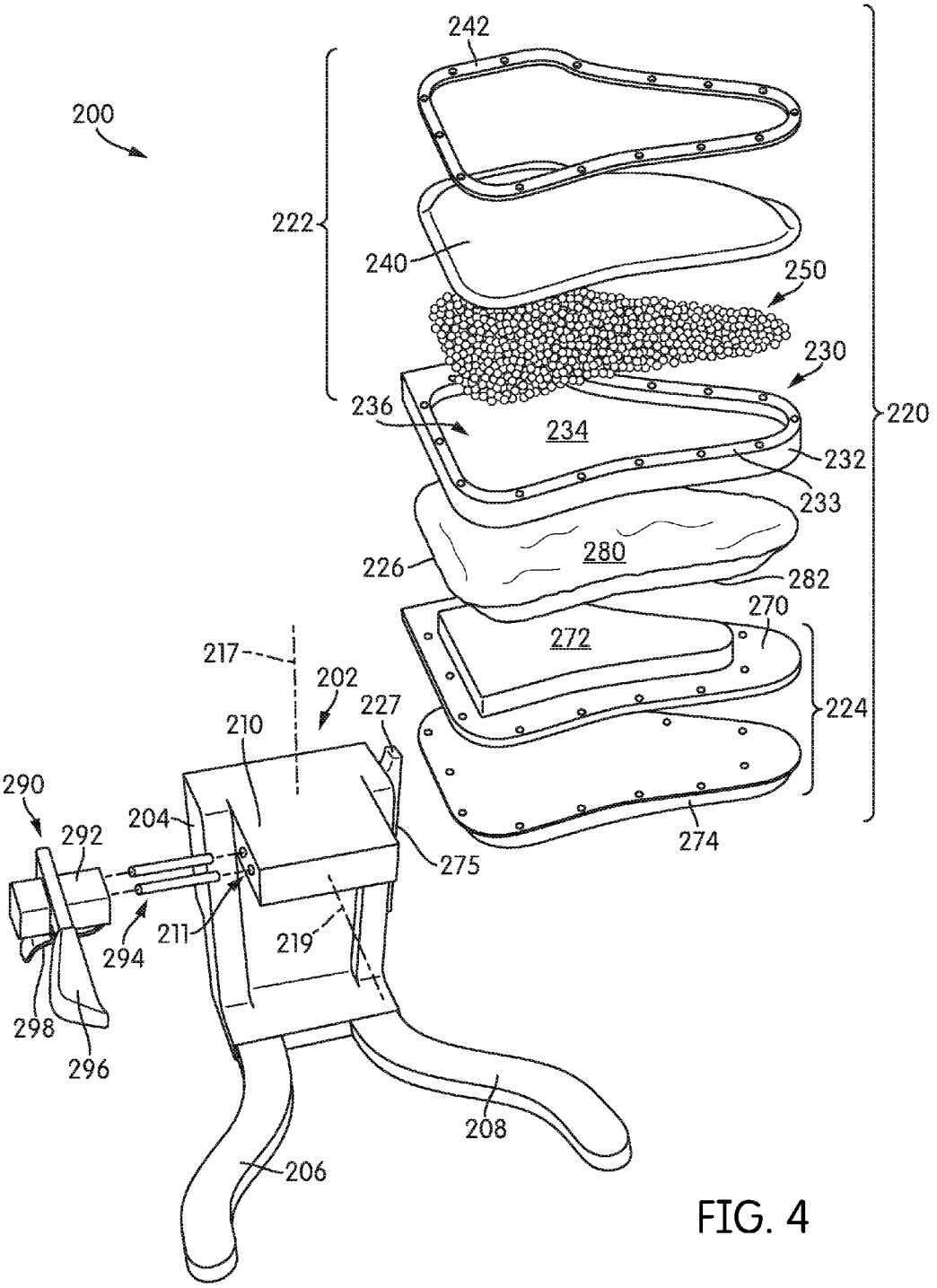
FIG. 4 is an exploded isometric view of an embodiment of a holding assembly.

FIGS. 2 through 4 illustrate various views of an embodiment of holding assembly 200. In particular, FIG. 2 illustrates a front isometric view, FIG. 3 illustrates a bottom up isometric view and FIG. 4 illustrates an exploded isometric view of holding assembly 200. Referring to FIGS. 2 through 4, base portion of holding assembly 202 may include body portion 204, first leg portion 206 and second leg portion 208. Body portion 204 comprises an approximately rectangular portion that is generally upright. Body portion 204 may be supported by first leg portion 206 and second leg portion 208. Additionally, base portion of holding assembly 202 may include forward mounting portion 210, which connects last portion 220 with body portion 204.

As seen most clearly in FIG. 4, in some embodiments, body portion 204 and forward mounting portion 210 may be substantially perpendicular. In particular, a first longitudinal axis 217 of body portion 204 may be substantially perpendicular with a second longitudinal axis 219 of forward mounting portion 210. In other embodiments, first longitudinal axis 217 and second longitudinal axis 219 could form any other angle.

In some embodiments, last portion 220 comprises various components that receive an article and help control the position, orientation and geometry of an upper. In some embodiments, last portion 220 may comprise a first side portion 222 and a second side portion 224. Additionally, last portion 220 may include bladder member 226, which may be disposed between first side portion 222 and second side portion 224.

In some embodiments, first side portion 222 may include a frame portion 230, including an outer sidewall portion 232 and a separating portion 234. In some cases, separating portion 234 may divides an upper recess 236 of frame portion 230 from a lower recess 238 (see FIG. 21) of frame portion 230. Upper recess 236 may be sealed off using flexible membrane 240 to form an interior chamber 246 (see FIG. 21). In some embodiments, flexible membrane 240 may be mounted to an upper edge 233 of outer sidewall portion 232 using gasket member 242. Gasket member 242 may be further fastened to frame member 230 at upper edge 233 using any types of fasteners known in the art.

In some embodiments, the interior chamber 246 that is formed between separating portion 234 of frame portion 230 and flexible membrane 240 may be filled with one or more materials. In some embodiments, interior chamber 246 may be filled with plurality of bead members 250. The term "bead member" as used throughout this detailed description and in the claims refers to any bead-like object having an approximately rounded shape. In particular, while some embodiments may include spherical beads, in other embodiments bead members may be non-spherical and may have, for example, oblong rounded shapes.

When assembled together, flexible membrane 240 and plurality of bead members 250 provide a substantially flexible and/or moldable outer surface for first side portion 222 of last portion 220. In particular, outer surface 260 of first side portion 222 may take a variety of different shapes as flexible membrane 240 is depressed in various locations and plurality of bead members 250 are rearranged within the resulting volume formed between flexible membrane 240 and frame portion 230. This configuration may allow outer surface 260 to deform in response to forces applied by an article that is placed onto last portion 220.

In some embodiments, second side portion 224 may include a base plate 270. In some embodiments, base plate 270 may further comprise a raised central portion 272. Moreover, in some embodiments, a contoured member 274 may be attached to base plate 270. In particular, contoured member 274 may be attached to an outer side of base plate 270, such that contoured member 274 is exposed outwardly on second side portion 224.

In contrast to first side portion 222, which has a generally flexible and deformable outer surface on last portion 220, second side portion 224 may have a substantially rigid outer surface. In some embodiments, for example, contoured member 274 could be a substantially rigid material that deflects and/or deforms little in response to forces that might be applied by an article placed onto last portion 220.

In some embodiments, attachment between first side portion 222 and second side portion 224 may be partially facilitated by bladder member 226. In one embodiment, bladder member 226 includes a first face 280 that is attached to frame portion 230 of first side portion 222. In some cases, first face 280 attaches to separating portion 234 within lower recess 238 (see FIG. 21), so that a portion of bladder member 226 may be disposed within first side portion 222. Additionally, bladder member 226 may include a second face 282 that is attached to central portion 272 of base plate 270. With this arrangement, as bladder member 226 expands, this may cause first side portion 222 and second side portion 224 to separate from one another.

In some embodiments, first side portion 222 and second side portion 224 may be further connected to one another in the area adjacent to forward mounting portion 210 of base portion of holding assembly 202. For example, in some embodiments, first side portion 222 may be fixed in place with respect to mounting portion 210 and second side portion 224 may pivot about forward mounting portion 210. In particular, in some embodiments, second side portion 224 may attach to forward mounting portion 210 at a hinge-like connection. In other embodiments, however, first side portion 222 may be fixed in place with respect to forward mounting portion 210, but second side portion 224 may not be directly attached to forward mounting portion 210. Instead, in some embodiments, second side portion 224 may only be attached to first side portion 222 by way of bladder member 226.

Materials used for various components and elements of last portion 220 may vary according to various factors including manufacturing costs, desired material properties as well as possibly other factors. As an example, in different embodiments the materials used for flexible membrane 240 could vary. Examples of flexible materials that may be used include, but are not limited to: flexible textiles, natural rubber, synthetic rubber, silicone, elastomers, other elastomers such as silicone rubber, as well as other materials known in the art. As another example, materials used for plurality of bead members 250 may vary from one embodiment to another. Examples of materials that could be used for bead members include, but are not limited to: plastic beads, silicone beads, metal beads (including, for example, ball bearings) as well as other kinds of materials known in the art. Furthermore, materials used for frame portions and various plates of a last portion can vary. Examples of materials that can be used for frame portions and/or plates include, but are not limited to, metals or metal alloys such as aluminum, plastics, as well as any other kinds of materials known in the art.

In different embodiments, the materials used for bladder member 226 can vary. In some embodiments, bladder member 226 may comprise of a rigid to semi-rigid material. In other embodiments, bladder member 226 may comprise of a substantially flexible material. In some embodiments, bladder member 226 can be made of a substantially flexible and resilient material that is configured to deform under fluid forces. In some cases, bladder member 226 can be made of a plastic material. Examples of plastic materials that may be used include high density polyvinyl-chloride (PVC), polyethylene, thermoplastic materials, elastomeric materials as well as any other types of plastic materials including combinations of various materials. In embodiments where thermoplastic polymers are used for a bladder, a variety of thermoplastic polymer materials may be utilized for the bladder, including polyurethane, polyester, polyester polyurethane, and polyether polyurethane. Another suitable material for a bladder is a film formed from alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A bladder may also be formed from a flexible microlayer membrane that includes alternating layers of a gas barrier material and an elastomeric material, as disclosed in U.S. Pat. Nos. 6,082,025 and 6,127,026 to Bonk et al., both hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Additional suitable materials are disclosed in U.S. Pat. Nos. 4,183,156 and 4,219,945 to Rudy, hereby incorporated by reference. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference. In one embodiment, bladder member 226 may comprise one or more layers of thermoplastic-urethane (TPU).

Holding assembly 200 may also include additional features for holding an article in place on last portion 220. In some embodiments, holding assembly 200 may include adjustable heel assembly 290. Adjustable heel assembly 290 may be used to accommodate a variety of different footwear sizes.

In some embodiments, adjustable heel assembly 290 may further include a body portion of adjustable heel assembly 292. Body portion of adjustable heel assembly 292 may be adjustably connected to forward mounting portion 210 via rods 294. In particular, rods 294 may extend outwardly from forward mounting portion 210 and may be received by body portion of adjustable heel assembly 292. In some embodiments, body portion of adjustable heel assembly 292 may be permanently fixed in place with respect to rods 294. In such embodiments, the position of body portion of adjustable heel assembly 292 relative to forward mounting portion 210 may be adjusted by sliding rods 294 to various positions within receiving cavities 211 of forward mounting portion 210. In other embodiments, body portion of adjustable heel assembly 292 may be configured to translate relative to rods 294. In such embodiments, the position of body portion of adjustable heel assembly 292 relative to forward mounting portion 210 may be adjusted by sliding body portion of adjustable heel assembly 292 along the length of rods 294.

Adjustable heel assembly 290 may include a heel engaging portion 296 that extends out from body portion of adjustable heel assembly 292. In some embodiments, heel engaging portion 296 may extend in a direction that is generally perpendicular to the direction that body portion of adjustable heel assembly 292 translates with respect to forward mounting portion 210. In some embodiments, the position and orientation of heel engaging portion 296 may be substantially fixed with respect to body portion of adjustable heel assembly 292. With this arrangement, heel engaging portion 296 may be configured to translate with body portion of adjustable heel assembly 292. Moreover, as discussed in further detail below, this arrangement allows the position of heel engaging portion 296 to be adjusted relative to a rearward edge of last portion 220.

In some embodiments, heel engaging portion 296 may have a shape that generally approximates the shape of the heel of a foot. This may allow heel engaging portion 296 to accommodate the corresponding geometry of the heel region of an upper. In other embodiments, however, heel engaging portion 296 could have any other geometry.

In some embodiments, a handle 298 may provide leverage for translating body portion of adjustable heel assembly 292. When adjustable heel assembly 290 has been adjusted to a desired position, handle 298 may be rotated to lock adjustable heel assembly 290 in place. Various methods of locking the position of adjustable heel assembly 290 into place using handle 298 could be used. In some embodiments, for example, handle 298 may comprise a cam-like feature that creates a frictional force to prevent body portion of adjustable heel assembly 292 from translating with respect to rods 294 when handle 298 is in the locked position. However, it will be understood that in other embodiments any other methods for locking the position of body portion of adjustable heel assembly 292 could be used. Further details concerning the operation of adjustable heel assembly 290 are discussed in further detail below.

In some embodiments, holding assembly 200 may include provisions to help fix an article in place and prevent the article from moving around on last portion 220. In some embodiments, holding assembly 200 may include lace locking member 275. Lace locking member 275 may extend outwardly from body portion 204. In some cases, lace locking member 275 includes a first catching portion 277 and a second catching portion 279. Moreover, in some embodiments, lace locking member 275 may be disposed on the side of holding assembly 200 associated with the toe region of last portion 220, so that the lace of an article can easily be pulled taut between the article and lace locking member 275. As discussed in further detail below, lace locking member 275 may be configured to receive laces of an article, which may be wrapped around lace locking member 275 to help hold the article in tension.

Some embodiments may include provisions to facilitate the flow of fluid into and out of various components of holding assembly 200. In particular, some embodiments can include provisions to control the pressure of bladder member 226. Likewise, some embodiments can include provisions to control the pressure within interior chamber 246 (which is sealed between flexible membrane 240 and frame member 230). Such provisions may facilitate the expansion (and possibly the contraction) of bladder member 226, as well as the contraction of interior chamber 246 (e.g., by creating a vacuum within interior chamber 246).

Figure 5:
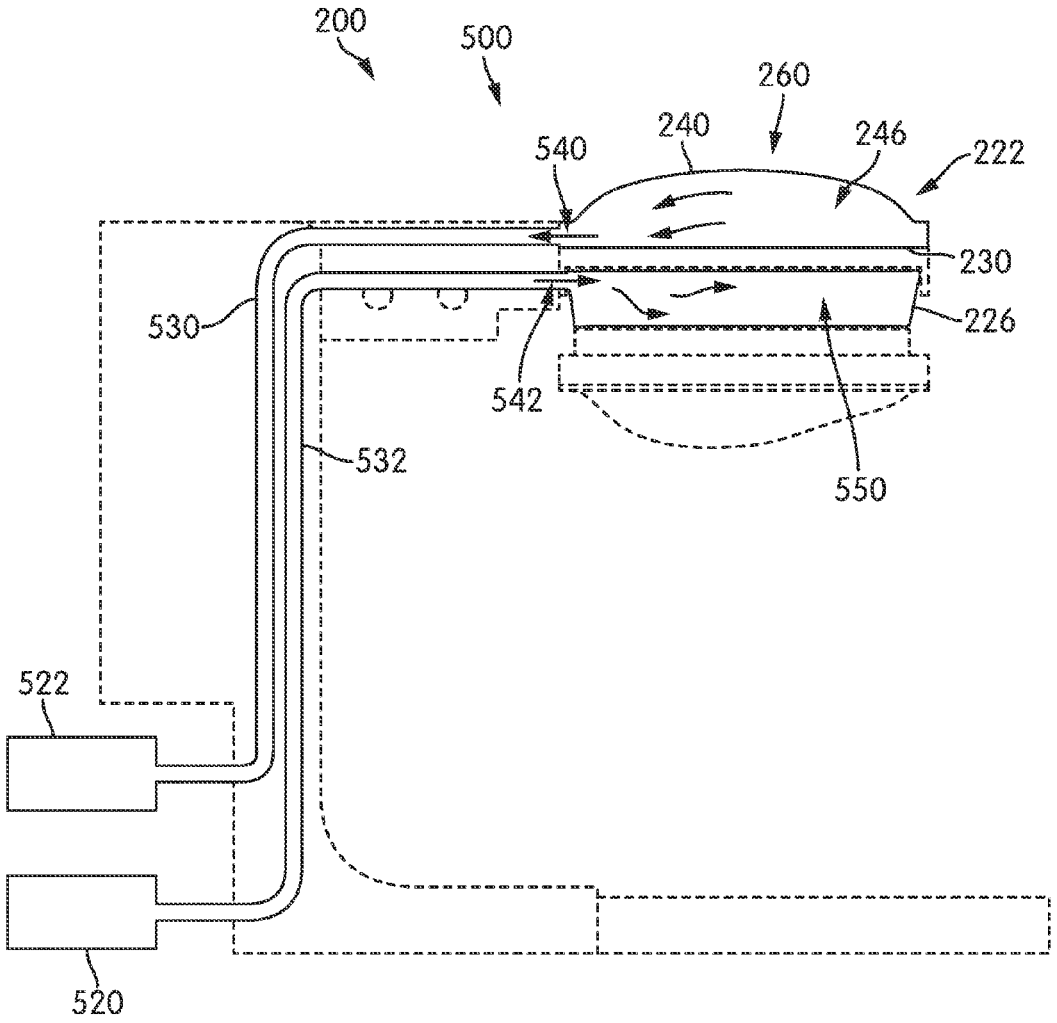
FIG. 5 is a side schematic view of an embodiment of a holding assembly indicating provisions for applying pressure and a vacuum to portions of the holding assembly.

FIG. 5 illustrates a schematic side view of an embodiment of holding assembly 200, in which some components of an adjustable pressure system 500 are shown in solid, while other components of holding assembly 200 are shown in phantom. For purposes of clarity, the various components of holding assembly 200 are shown schematically.

Referring to FIG. 5, adjustable pressure system 500 includes bladder member 226, as well as interior chamber 246 (the location of interior chamber 246 is indicated schematically in FIG. 5) that is bounded by flexible membrane 240 and frame portion 230. Additionally, adjustable pressure system 500 may include provisions for facilitating fluid communication between bladder member 226 and a first external fluid pump 520 as well as between interior chamber 246 and a second external fluid pump 522.

In some embodiments, first external fluid pump 520 is a pump configured to fill bladder member 226 with fluid. In other words, in some embodiments, first external fluid pump 520 may be operated to increase the fluid pressure within bladder member 226, which may cause bladder member 226 to expand. In some embodiments, first external fluid pump 520 could also be configured to operate in a manner that draws fluid from bladder member 226, thereby decreasing the internal pressure within bladder member 226. This mode of operation would allow bladder member 226 to be automatically deflated.

In some embodiments, second external fluid pump 522 is a vacuum pump configured to draw fluid from interior chamber 246. In particular, second external fluid pump 522 may be used to significantly decrease the fluid pressure in interior chamber 246, which may pull flexible membrane 240 taut against plurality of beads 250 (as shown for example in FIG. 25). This may create a generally rigid arrangement for outer surface 260 of first side portion 222.

Adjustable pressure system 500 may include provisions for transferring fluid between first external fluid pump 520 and bladder member 226 as well as between second external fluid pump 522 and interior chamber 246. In some embodiments, tube 530 may connect second external fluid pump 520 with interior chamber 246. In particular, tube 530 may be connected to a fluid port 540 of interior chamber 246. In some embodiments, tube 532 may connect first external fluid pump 520 with an interior chamber 550 of bladder member 226. In particular, tube 532 may be connected to a fluid port 542 of interior chamber 550.

For purposes of illustration, some components of adjustable pressure system 500 are shown schematically in the Figures. In different embodiments, various configurations of fluid pumps, fluid lines (i.e., tubes or hoses), fluid ports as well as other fluid transfer provisions may be used. In some embodiments, tube 530 and tube 532 may extend along a rearward side of base portion of holding assembly 202, and could pass through openings beneath forward mounting portion 210. In other embodiments, any other arrangement of tube 530 and/or tube 532 within base portion of holding assembly 202 and/or last portion 220 could be used. In still further embodiments, one or more fluid valves could be used to control the amount and/or direction of fluid between fluid pumps and components of holding assembly 200.

The operation of first external fluid pump 520 and second external fluid pump 522 may be manual or automatic. As an example, in one embodiment, a user may control first external fluid pump 520 and/or second external fluid pump 522 using manual controls at each pump. As another example, in some embodiments, first external fluid pump 520 and/or second external fluid pump 522 could be controlled automatically using computing system 101 or any other automated system in communication with first external fluid pump 520 and/or second external fluid pump 522.

Thus, it can be seen by this arrangement that the pressure of bladder member 226 may be actively increased and while the pressure of interior chamber 246 may be actively decreased. More specifically, the pressure of bladder member 226 may be increased to expand last portion 220 while the pressure of interior chamber 246 is simultaneously decreased (i.e., a vacuum is applied) in order to evacuate interior chamber 246 of fluid and temporarily fix the geometry of first side portion 222. Further details of these operations are discussed in detail below.

For purposes of illustration, some of the provisions of adjustable pressure system 500 may not be shown in some figures. It will however be understood that the following embodiments may all include one or more of the features of adjustable pressure system 500 described here and indicated schematically in FIG. 5.

Figure 6:
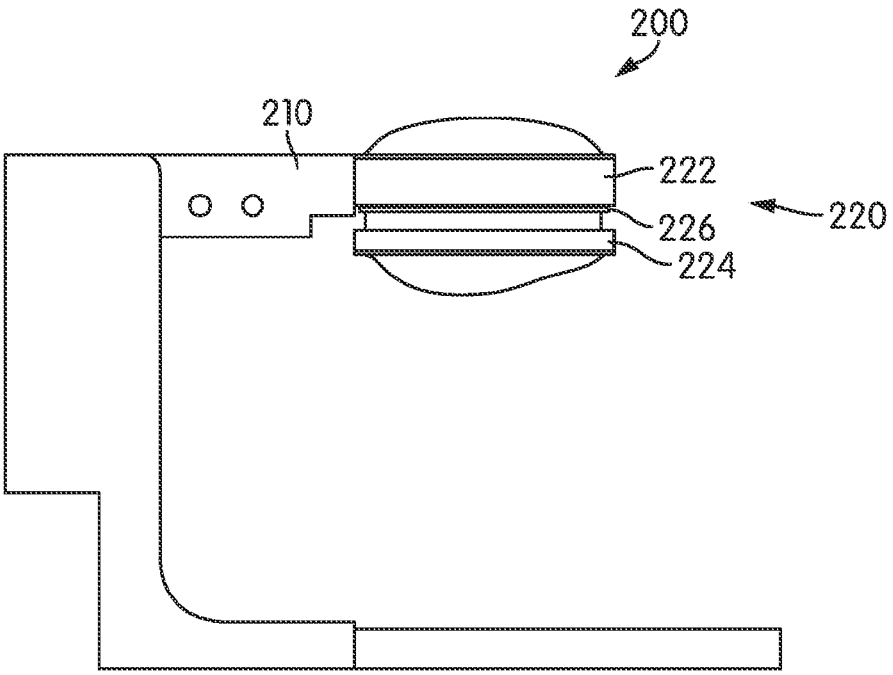
FIG. 6 is a side schematic view of an embodiment of a holding assembly, in which a last portion is in an unexpanded configuration.
Figure 7:
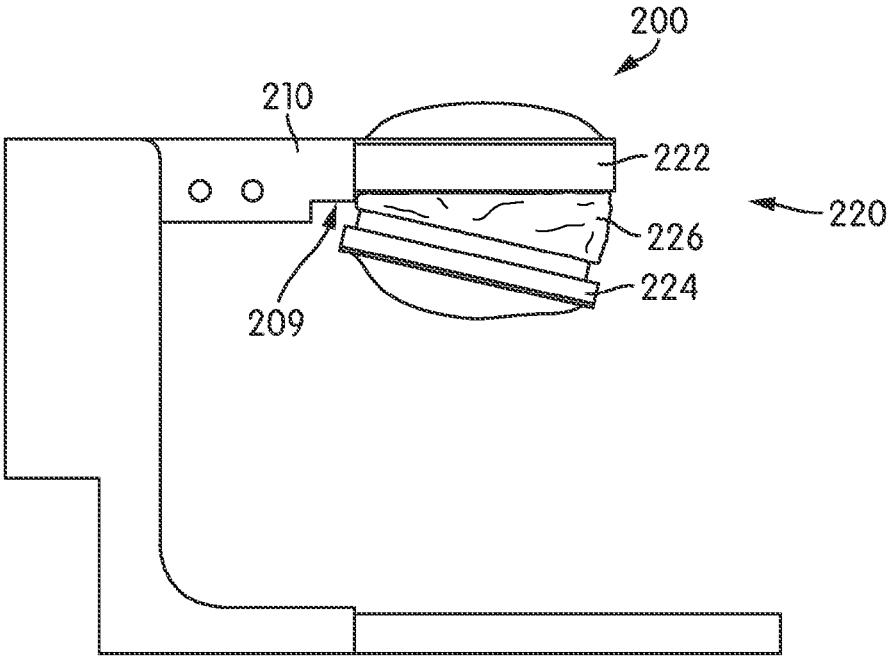
FIG. 7 is a side schematic view of an embodiment of a holding assembly, in which a last portion is in an expanded configuration.

FIGS. 6-7 illustrate side schematic views of the operation of last portion 220 as bladder member 226 is filled with fluid. In the low pressure, or deflated, configuration of bladder member 226 shown in FIG. 6, second side portion 224 may be disposed directly adjacent to first side portion 222. Moreover, in this lower pressure configuration, second side portion 224 may be approximately parallel with first side portion 222. However, in the pressurized, or inflated, configuration of bladder member 226 shown in FIG. 7, second side portion 224 may be separated from first side portion 222. More specifically, in some embodiments, second side portion 224 tilts away from first side portion 222 at an angle. In some embodiments, second side portion 224 may generally pivot about the forwardmost portion 209 of forward mounting portion 210, which is where last portion 220 joins connecting portion 210.

This arrangement allows the width of last portion 220 to vary according to the pressure of bladder member 226. Moreover, once an article has been placed onto last portion 220, inflating bladder member 226 may cause last member 220 to expand to fill the interior of the article, which may help keep the article mounted on last portion 220.

As previously discussed, first side portion 222 may comprise a moldable or flexible outer surface that can be deformed in response to applied pressures or forces. Moreover, the rigidity of first side portion 222 may be varied through the use of vacuum pressure.

Figure 8:
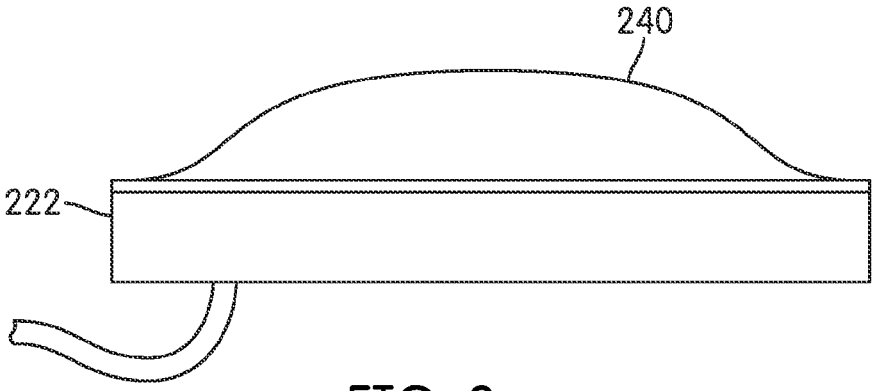
FIG. 8 is a side schematic view of an embodiment of a first side portion of a last portion.
Figure 9:
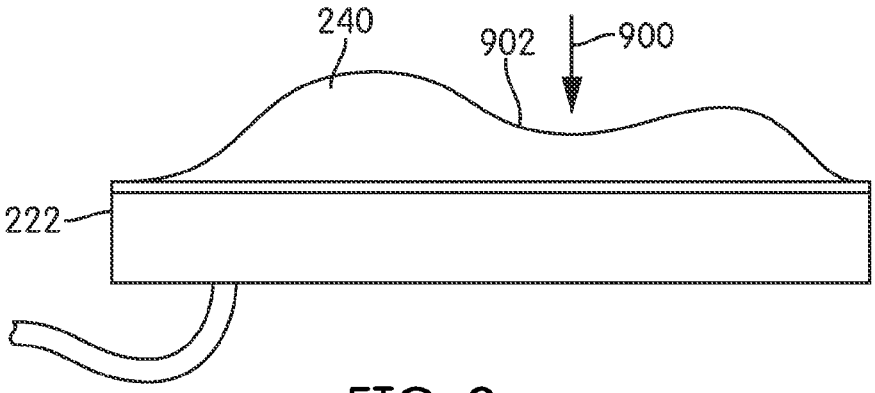
FIG. 9 is a side schematic view of the first side portion of FIG. 8, in which the outer surface changes shape in response to a deforming force.
Figure 10:
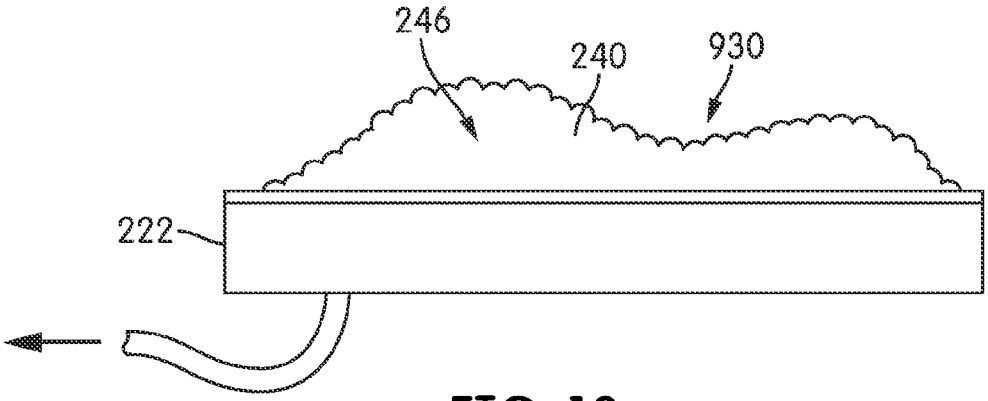
FIG. 10 is a side schematic view of the first side portion of FIG. 9, in which the shape of the outer surface is temporarily fixed using a vacuum.

FIGS. 8-10 illustrate schematic side views of embodiments of first side portion 222 of last portion 220 in isolation. In the configuration shown in FIG. 8, first side portion 222 presents a substantially flexible outer surface at flexible membrane 240. As seen in FIG. 9, as a force 900 is applied to flexible membrane 240, flexible membrane 240 deforms in a manner that creates depression 902. Referring next to FIG. 10, by creating a vacuum within interior chamber 246 of first side portion 222, flexible membrane 240 is pulled taut against the plurality of beads 250 (see FIG. 25). This results in a substantially rigid outer surface 930 for first side portion 222. Using this arrangement, the contouring or geometry of first side portion 222 can be varied by subjecting first side portion 222 to various pressures and/or forces.

Figure 31:
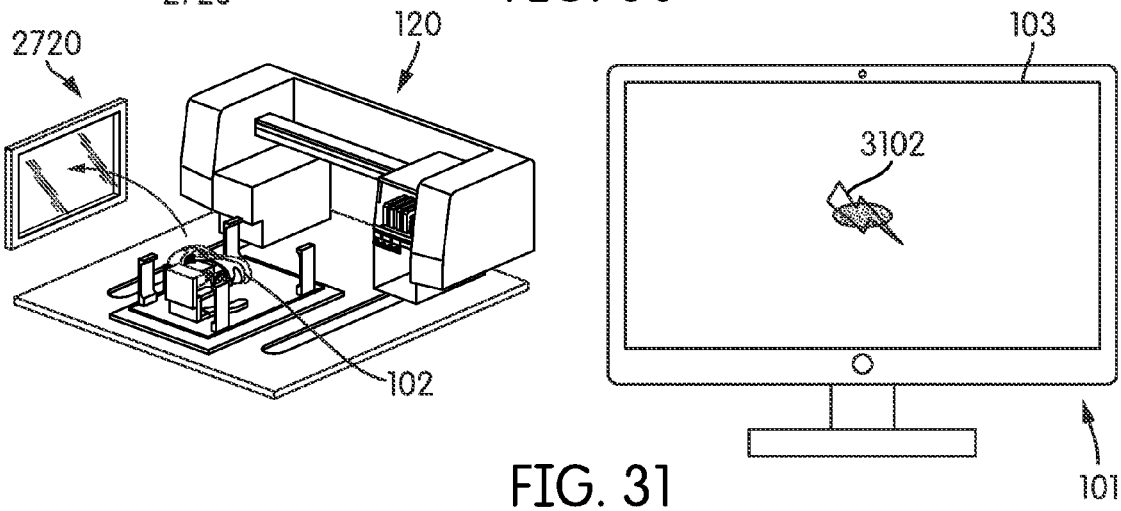
FIG. 31 is a schematic view of a step in a process of preparing an article for printing, according to an embodiment.
Figure 32:
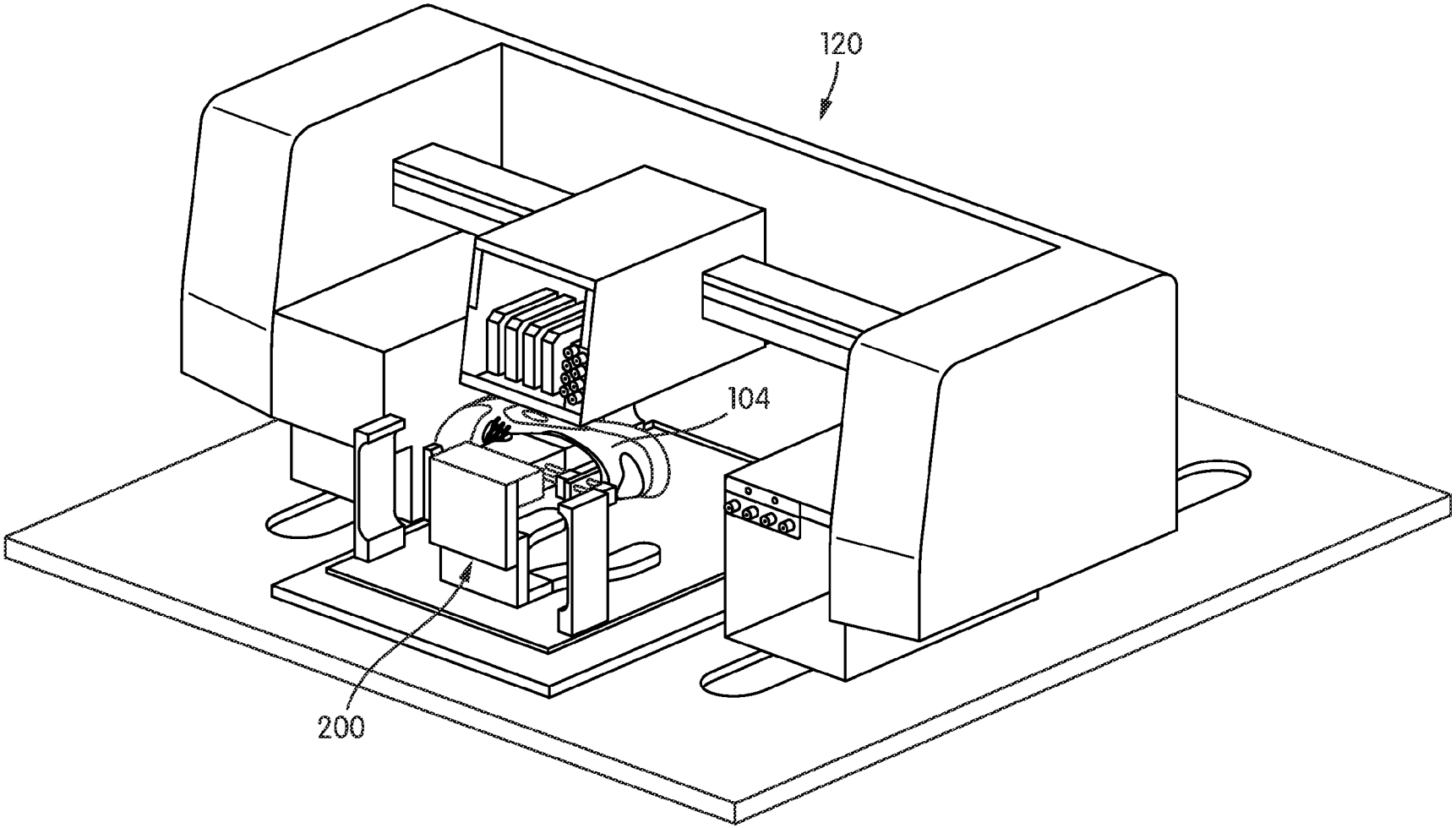
FIG. 32 is a schematic isometric view of an embodiment of a printing system printing to an article of footwear.
Figure 33:
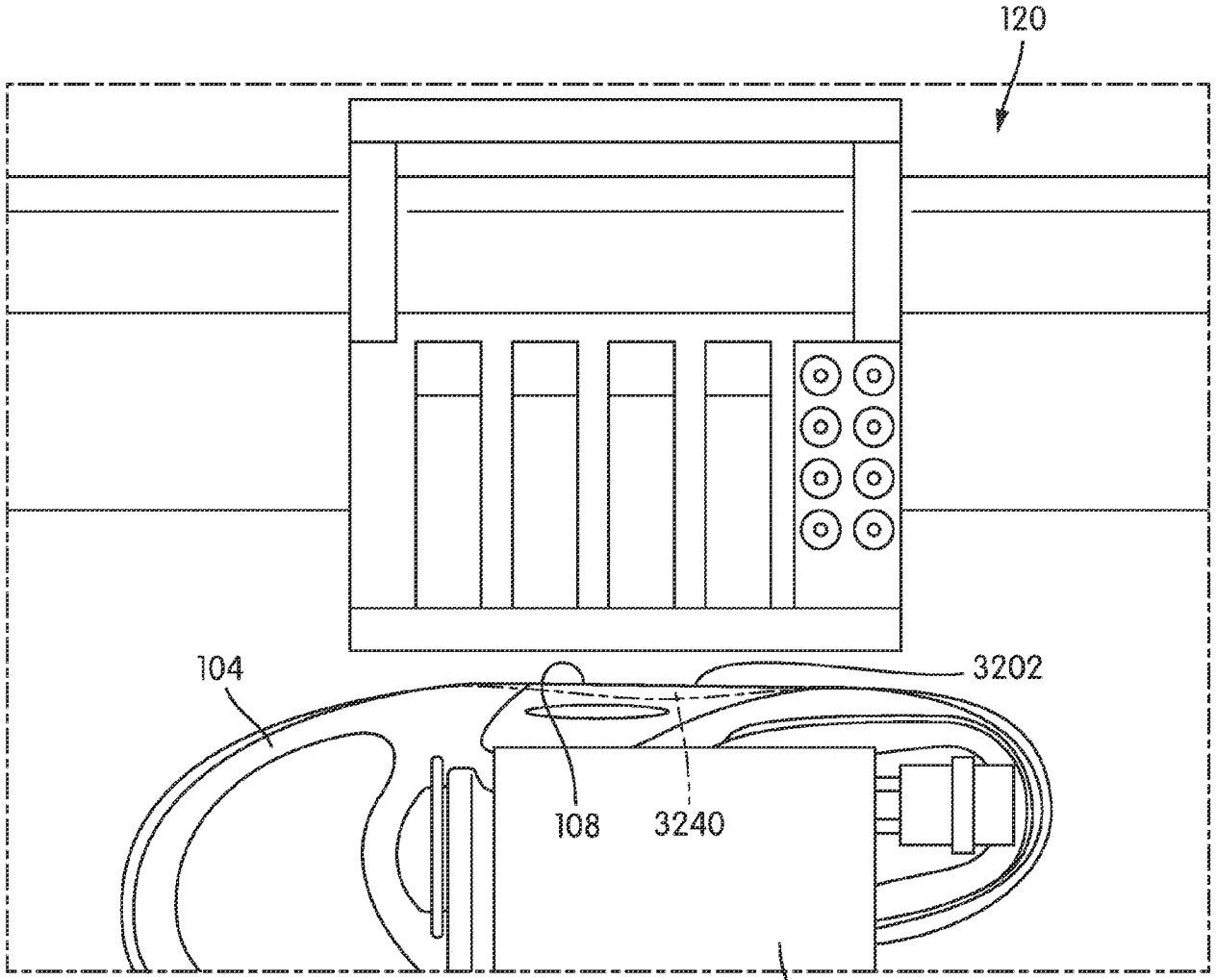
FIG. 33 is a schematic front on view of an embodiment of a printing system printing to an article of footwear.
Figure 34:
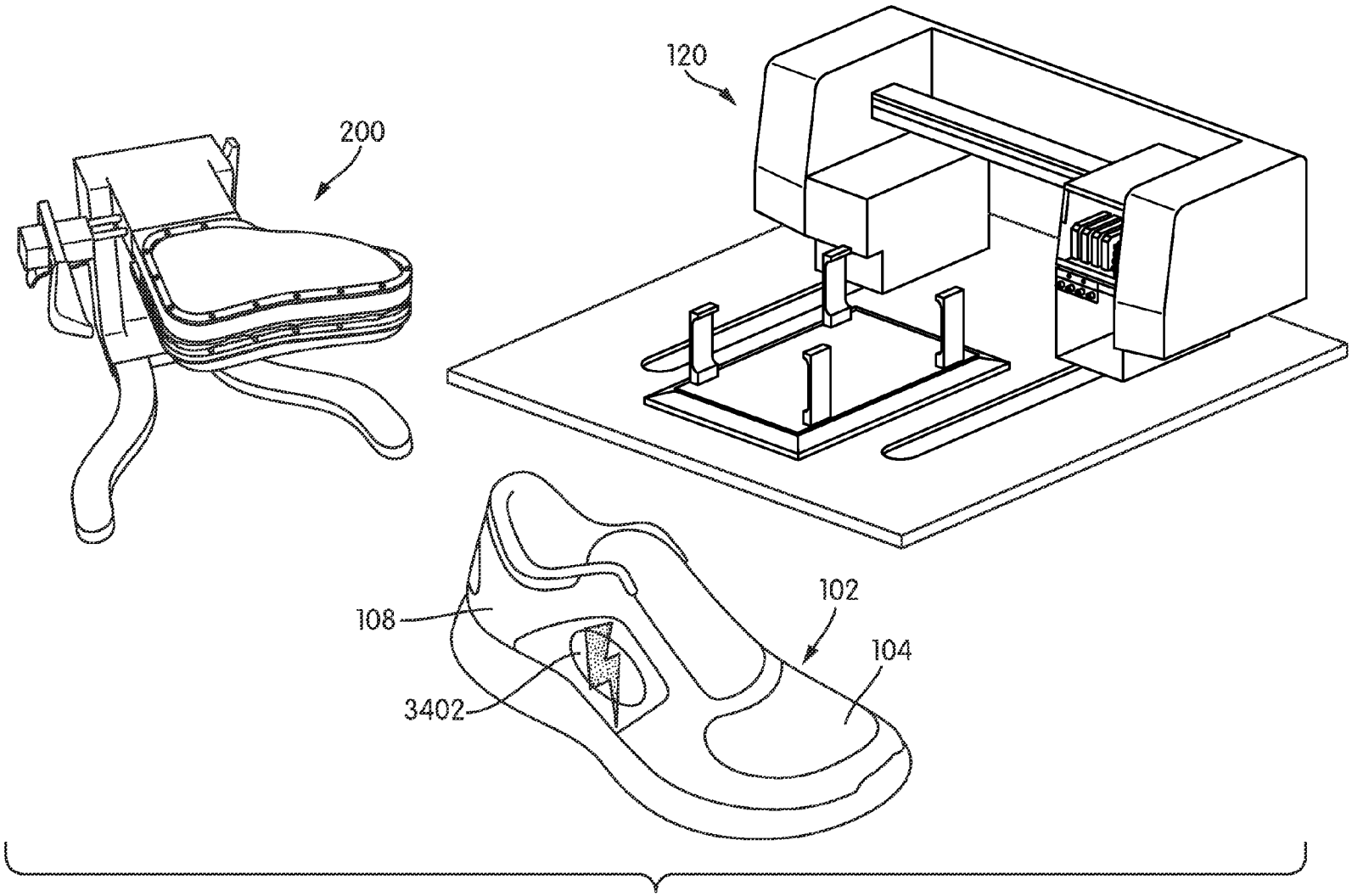
FIG. 34 is a schematic view of various components of an embodiment of a flexible manufacturing system after a graphic has been printed to an article of footwear.

FIGS. 11 through 34 illustrate schematic views of an embodiment of a method for printing a graphic onto an article of footwear. In particular, FIGS. 11 through 18 illustrate an exemplary process for securing an article of footwear on a holding assembly, FIGS. 19 through 31 illustrate an exemplary process for preparing an article for printing and FIGS. 32 through 34 illustrate an exemplary process for printing onto an article.

FIGS. 11-16 illustrate schematic top down views of an embodiment of article 102 disposed on holding assembly 200. In particular, FIGS. 11 through 16 illustrate an exemplary process for adjusting the position of adjustable heel assembly 290 in order to help secure article 102 to last portion 220.

As seen in FIGS. 11 through 16, heel engaging portion 296 may generally extend in an approximately parallel direction with a rearward edge 291 of last portion 220. Thus, the position of heel engaging portion 296 may be adjusted to accommodate various different sizes of footwear. In other words, the distance between heel engaging portion 296 and forward portion 223 of last portion 220 may be changed to accommodate different footwear sizes.

Figure 11:
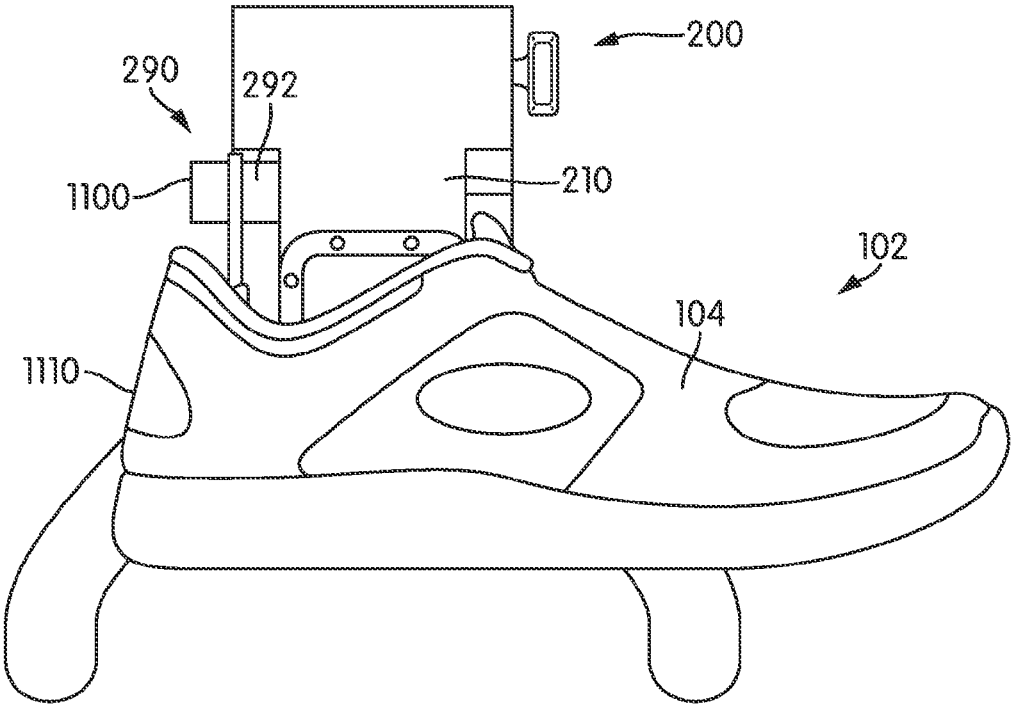
FIG. 11 is a top down view of an embodiment of an article of footwear mounted to a holding assembly, where an adjustable heel assembly is in a retracted position.
Figure 12:
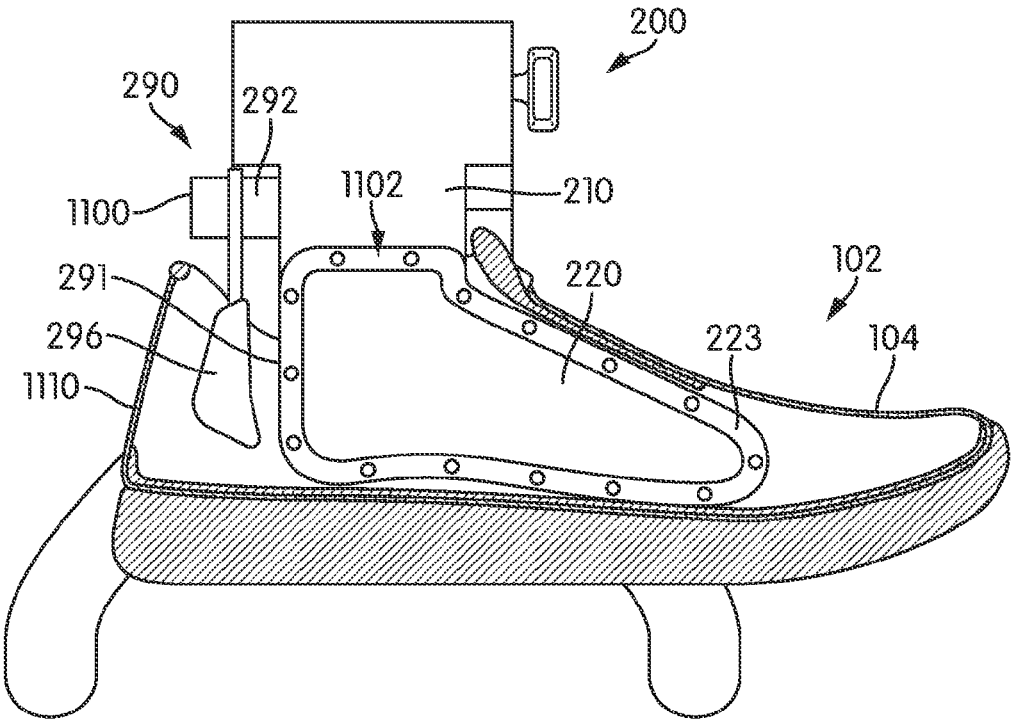
FIG. 12 is a schematic cross-sectional view of the article of FIG. 11.

Initially, as shown in FIGS. 11 and 12, adjustable heel assembly 290 may be in a first position 1100, in which adjustable heel assembly 290 is fully retracted towards forward mounting portion 210. With adjustable heel assembly 290 in first position 1100, upper 104 may be easily placed on (or taken off) of last portion 220, as last portion 220 and adjustable heel assembly 290 may both easily be inserted into opening 1102 of upper 104. As seen in FIG. 12, heel engaging portion 296 may be spaced inwardly from heel portion 1110 of upper 104.

Figure 13:
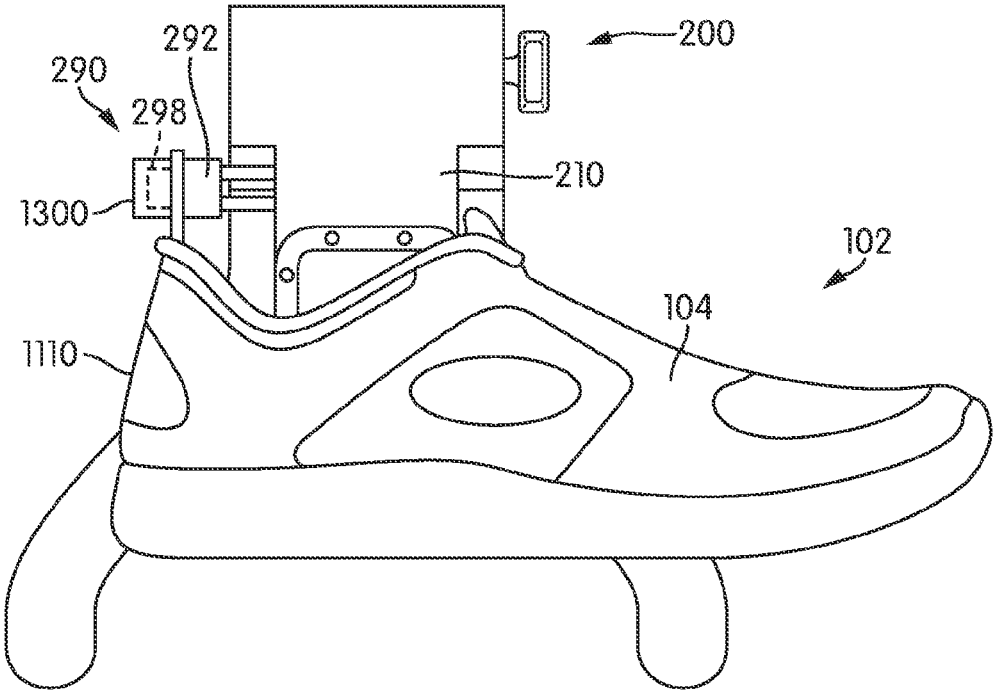
FIG. 13 is a top down view of an embodiment of the article and holding assembly of FIG. 11, wherein the adjustable heel assembly has been adjusted to contact the heel portion of the article.
Figure 14:
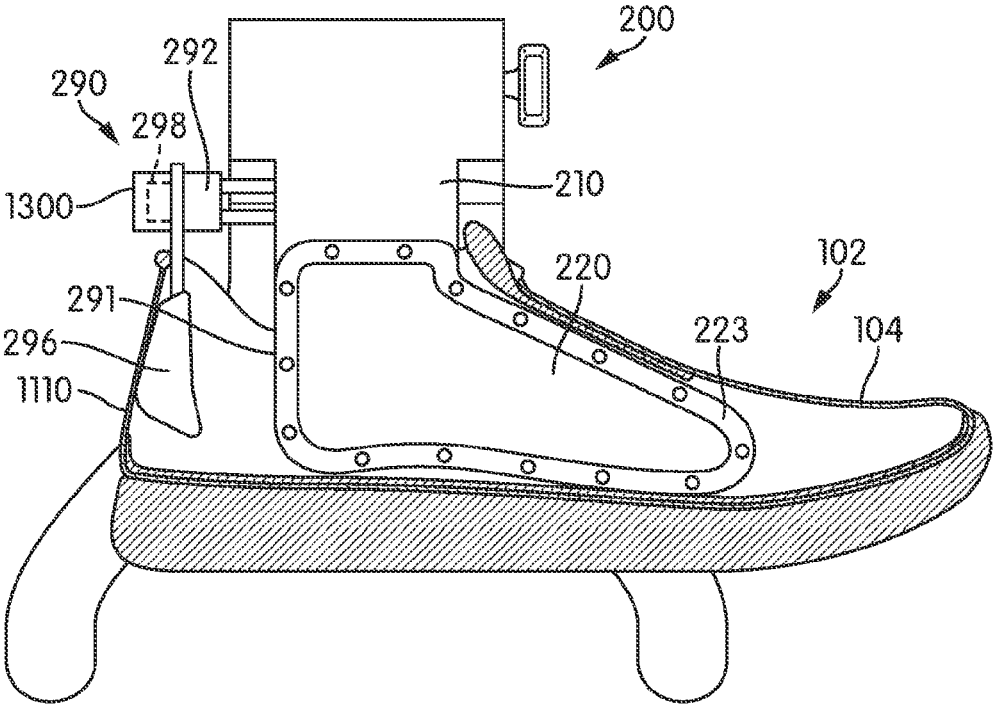
FIG. 14 is a schematic cross-sectional view of the article of FIG. 13.

In FIGS. 13 and 14, adjustable heel assembly 290 has been adjusted to second position 1300. In some embodiments, this may be accomplished by a user pulling on handle 298 (shown in phantom beneath body portion of adjustable heel assembly 292) to slide adjustable heel assembly 290 away from mounting portion 210. Moreover, in second position 1300, heel engaging member 296 may be disposed against heel portion 1110 of upper 104.

Figure 15:
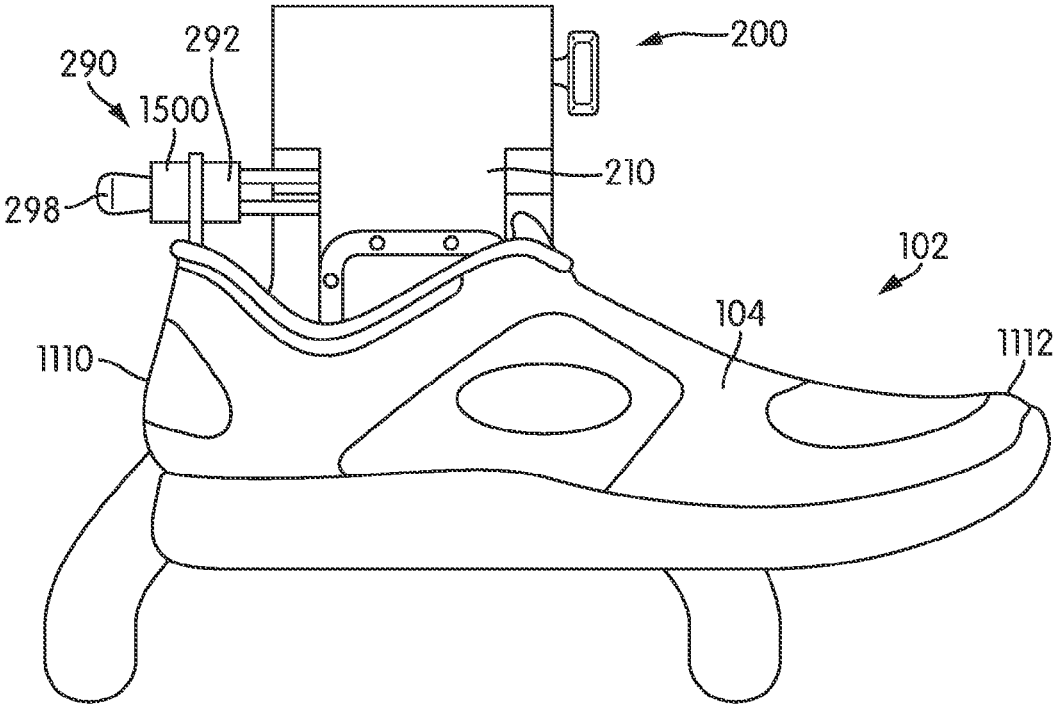
FIG. 15 is a top down view of an embodiment of the article and holding assembly of FIG. 11, wherein the adjustable heel assembly has been adjusted to tension the heel portion of the article.
Figure 16:
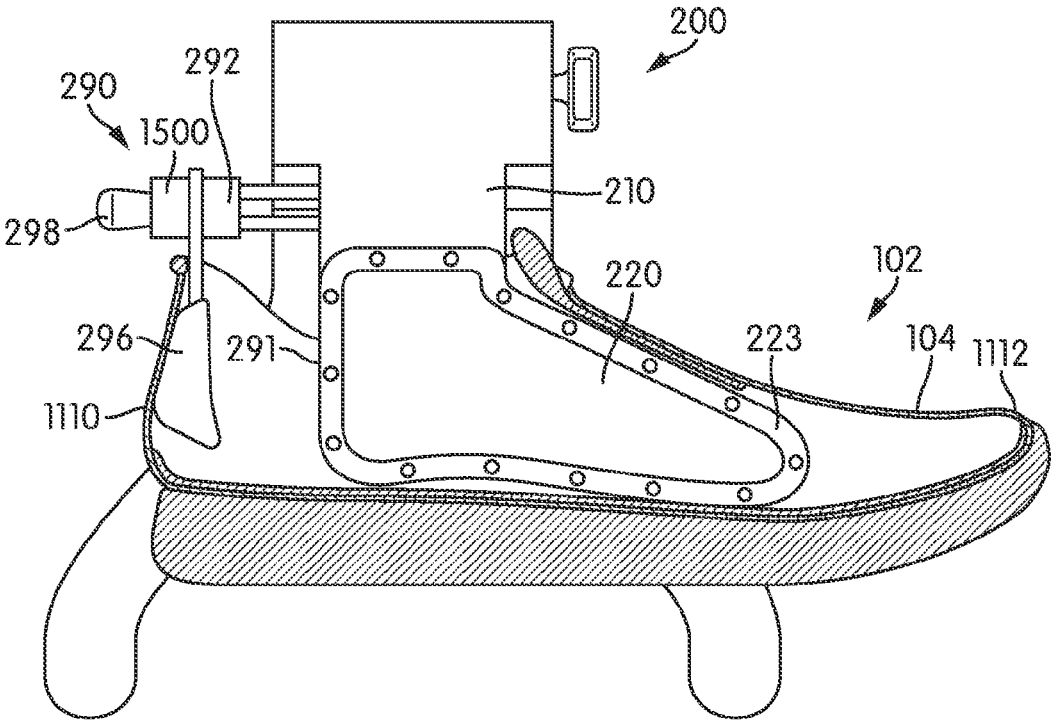
FIG. 16 is a schematic cross-sectional view of the article of FIG. 15.

In some embodiments, it may be desirable to place upper 104 in tension using adjustable heel assembly 290. Referring now to FIGS. 15 and 16, adjustable heel assembly 290 may be adjusted to third position 1500. In third position 1500, heel engaging portion 296 may stretch heel portion 1110 further outwards so that upper 104 is substantially tensioned between heel engaging portion 296 and toe portion 1112 of upper 104.

In some embodiments, the position of adjustable heel assembly 290 can be locked to prevent adjustable heel assembly 290 from retracting under the forces of heel portion 1110 of upper 104. As previously discussed, in some embodiments the position of adjustable heel assembly 290 may be locked by adjusting handle 298. As seen in the current example shown in FIGS. 11 through 14, handle 298 may be disposed in an unlocked position (below body portion of adjustable heel assembly 292 in these views) so that the position of adjustable heel assembly 290 can be changed. Moreover, when the desired position is achieved, a user may rotate handle 298 to the position illustrated in FIGS. 15 and 16, thereby locking adjustable heel assembly 290 in place.

Once adjustable heel assembly 290 has been adjusted to fit upper 102, a user may tighten the laces of article 102 using lace locking member 275.

Figure 17:
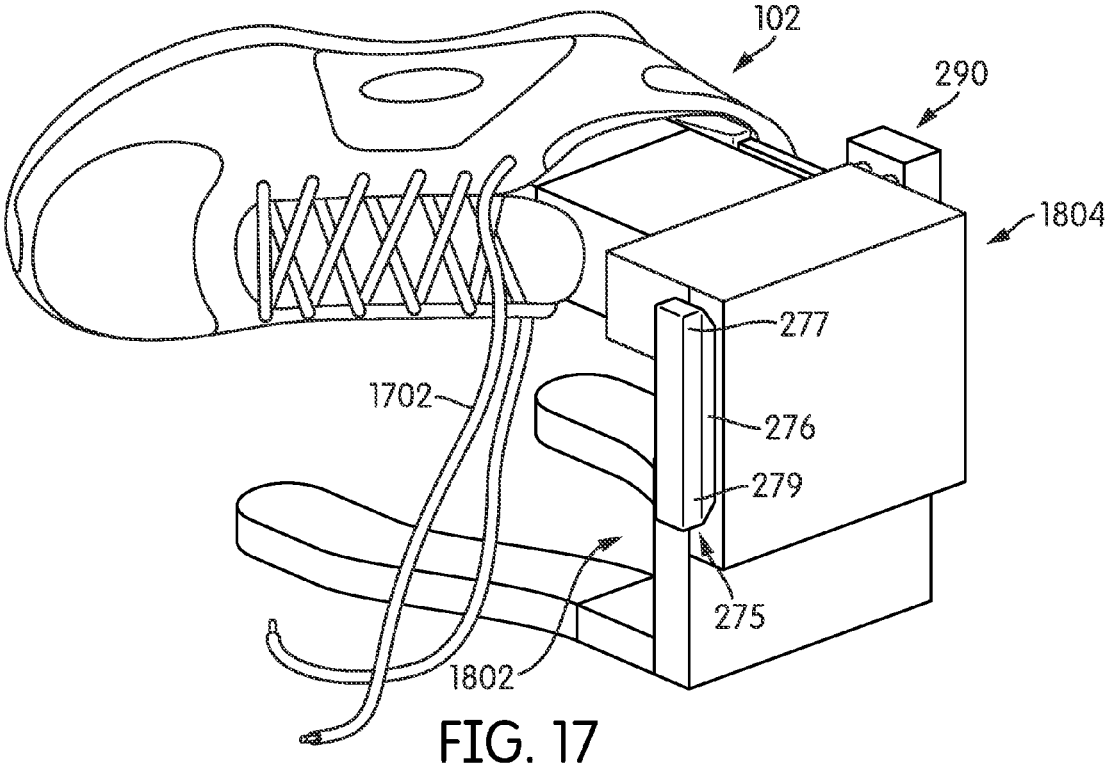
FIG. 17 is a schematic isometric view of an embodiment of an article of footwear mounted to a holding assembly, where a lace locking member is clearly seen on a base portion of the holding assembly.
Figure 18:
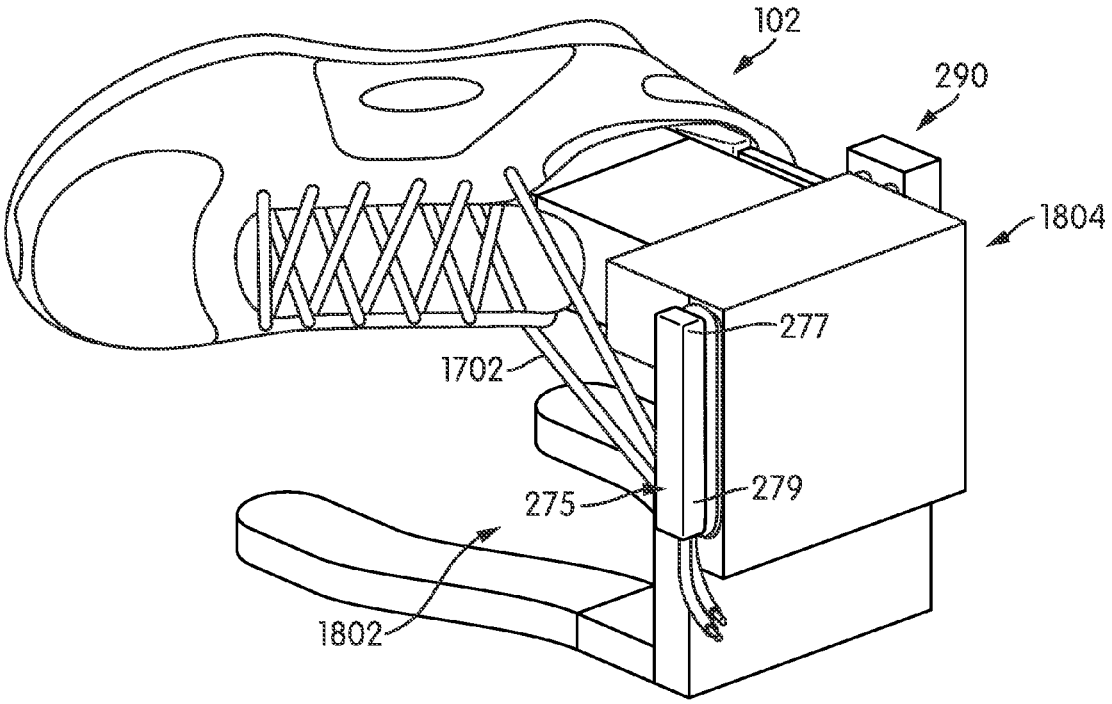
FIG. 18 is a schematic isometric view of the article of footwear and holding assembly of FIG. 17, where the laces of the article of footwear are tightened around the lace locking member.

FIGS. 17 and 18 illustrate schematic isometric views of article 102 in configurations before and after lace 1702 has been tensioned using lace locking member 275. As previously discussed, lace locking member 275 may extend outwardly from body portion 204 of holding assembly 200. In particular, a central portion 276 may extend outwardly from body portion 204. First catching portion 277 and second catching portion 279 may extend from central portion 276 such that first catching portion 277 and second catching portion 279 are spaced away from body portion 204. This arrangement may allow portions of a lace to be wrapped around central portion 276 such that the lace is disposed between first catching portion 277 and second catching portion 279 and body portion 204.

Referring to FIG. 17, lace 1702 may be in a loosened position following the mounting of article 102 to last portion 220. Referring next to FIG. 18, a user may wind lace 1702 around first catching portion 277 and second catching portion 279 to apply tension to upper 104. In some embodiments, lace 1702 may first be pulled taut prior to being wound onto lace locking member 275. With this arrangement, lace 1702 can be used to apply tension to upper 104 along a first side 1802 of holding assembly 200, while adjustable heel assembly 290 applies tension along second side 1804 of holding assembly 200. These tensioning forces may help to keep upper 104 locked onto last portion 220.

Figure 19:
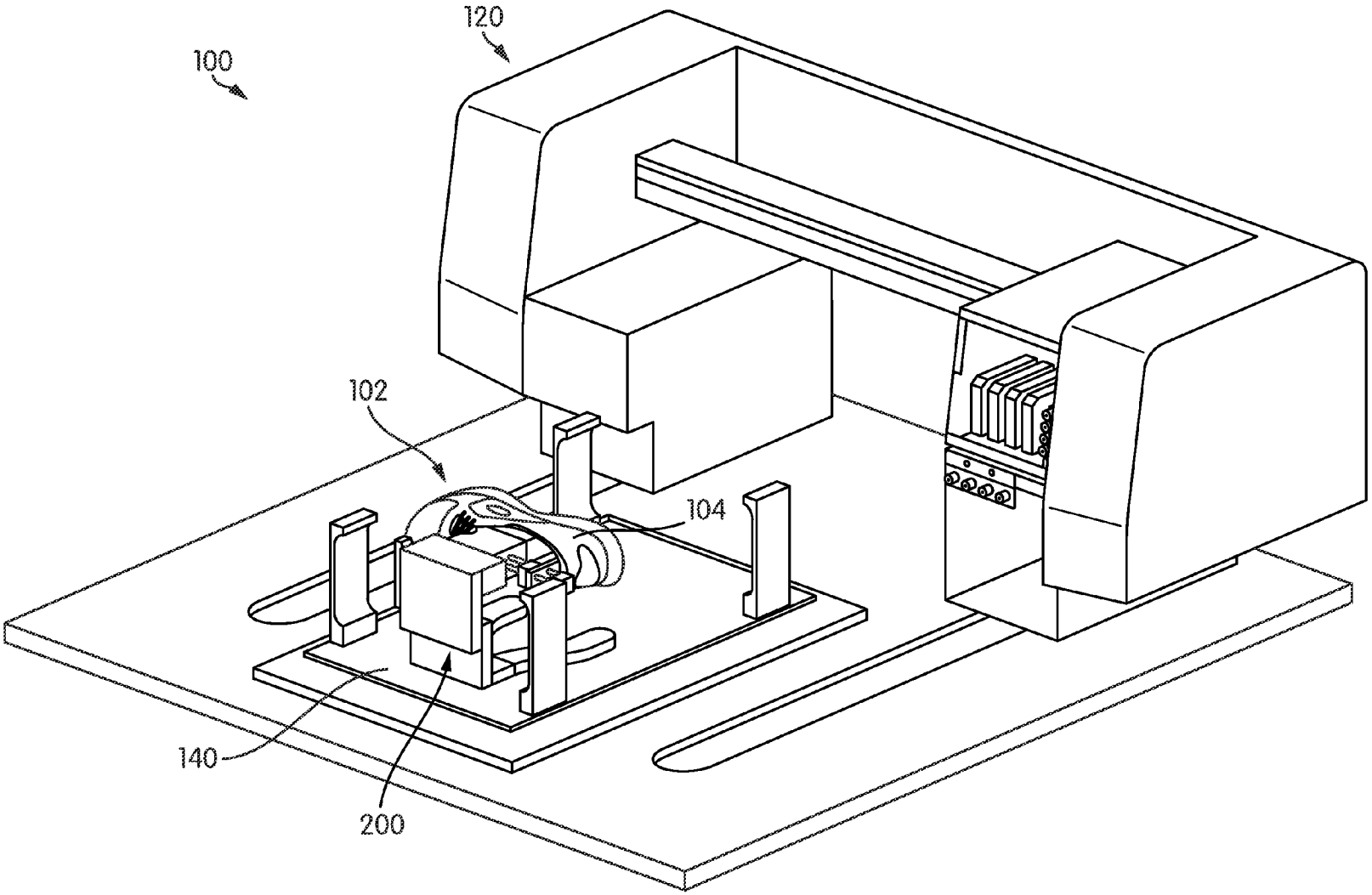
FIG. 19 is a schematic view of an embodiment of an article of footwear and an associated holding assembly placed on the platform of a flexible manufacturing system.

Referring now to FIG. 19, in order to prepare article 102 for printing, holding assembly 200 may be placed onto platform 140. Generally, holding assembly 200 may be placed onto any portion of platform 140, and may be oriented in any direction. In some embodiments, holding assembly 200 may be positioned and oriented to ensure that the printing heads of printing system 120 can be positioned over the desired portion of upper 104. In some embodiments, flexible manufacturing system 100 may include provisions to secure holding assembly 200 on platform 140 at a desired position and/or in a desired orientation. Such provisions are discussed in further detail below and shown in FIGS. 39-40.

Embodiments can include provisions that facilitate flattening portions of an article in order to improve printing quality. In some embodiments, a flexible manufacturing system may include a flattening plate that can be used to press an article on a holding assembly such that portions of the upper are deformed and temporarily flattened. In some embodiments, a flexible manufacturing system can include further provisions to ensure that the flattening plate can come into contact with the desired portion of the upper to be flattened.

Figure 20:
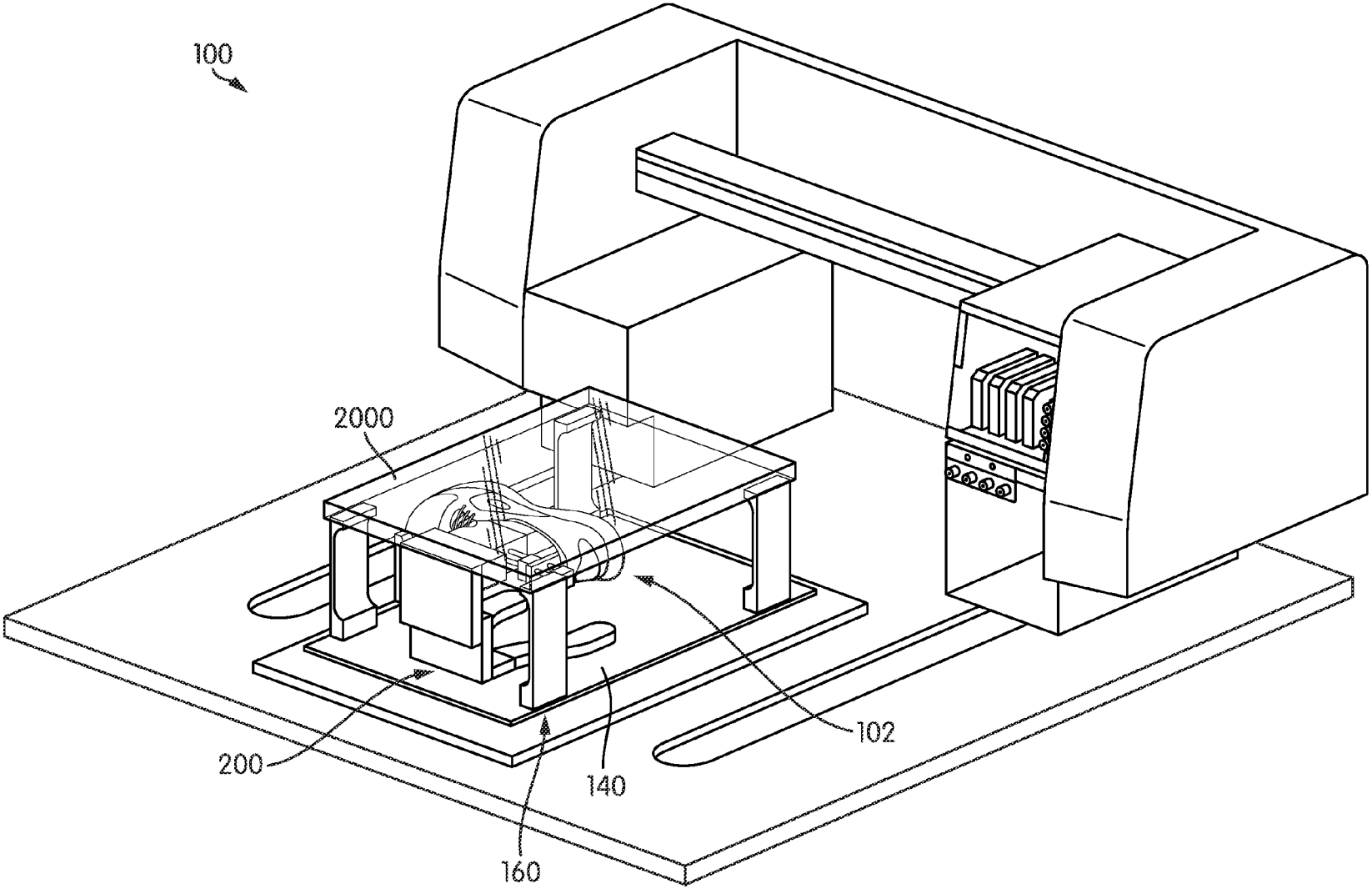
FIG. 20 is a schematic view of an embodiment of a flexible manufacturing system, where a flattening plate has been mounted to a plurality of mounting arms.

FIG. 20 illustrates an embodiment of flexible manufacturing system 100 that utilizes a flattening plate 2000 to apply pressure across portions of article 102. In some embodiments, flattening plate 2000 may be mounted to plurality of mounting arms 160. With this arrangement, flattening plate 2000 may be positioned over holding assembly 200 and article 102, which are disposed on platform 140. In some embodiments, flattening plate 2000 may be fastened to one or more of plurality of mounting arms 160 using any kinds of fasteners known in the art. In other embodiments, however, flattening plate 2000 may be manually held in place by a user. In still other embodiments, the weight of flattening plate 2000 may be sufficient to keep flattening plate 2000 resting on plurality of mounting arms 160.

In some embodiments, flattening plate 2000 may comprise a substantially rigid material. In some embodiments, flattening plate 2000 may comprise a sheet of plexi-glass material. In other embodiments, flattening plate 2000 could be made of any other materials including, but not limited to, polymer materials, metallic materials, wood, composite materials, glass materials or any other kinds of materials that may be rigid enough to press down on holding assembly 200 and article 102 without substantially deforming, bending, buckling or otherwise failing.

In some embodiments, the thickness of flattening plate 2000 could range between 0.01 inches and 2 inches. In other embodiments, the thickness of flattening plate 2000 could range between 1 inch and 5 inches. In still other embodiments, flattening plate 2000 could have any other thickness.

Figure 21:
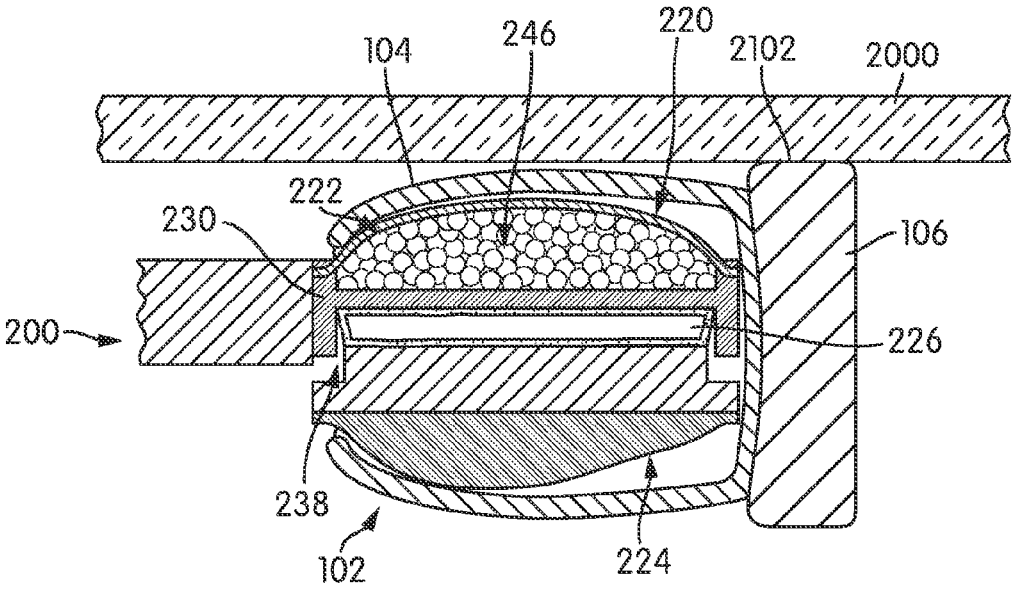
FIG. 21 is a schematic cross-sectional view of an embodiment of an article of footwear mounted to a last portion of a holding assembly with a flattening plate pressing down on the article.
Figure 22:
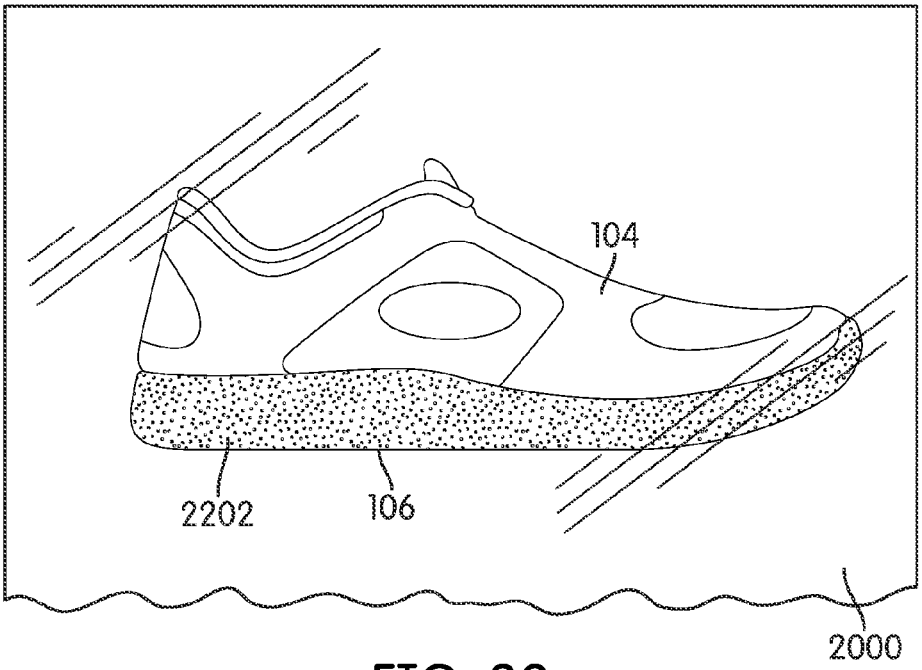
FIG. 22 is a top down schematic view of an embodiment of an article of footwear disposed beneath a flattening plate in which the contact area between the article of footwear and the flattening plate is highlighted.

FIG. 21 illustrates a cross sectional view of portions of holding assembly 200, article 102 and flattening plate 2000. As seen in FIG. 21, with the side portions of article 102 oriented in a generally parallel direction with first side portion 222 and second side portion 224, sole structure 106 may generally interfere with the ability of flattening plate 2000 to apply pressure directly to upper 102. Instead, in this initial configuration, the primary contact between flattening plate 2000 and article 102 may occur along a sidewall 2102 of sole structure 106. This area of contact between article 102 and flattening plate 2000 may also be seen in FIG. 22, which shows a top down view of article 102 through flattening plate 2000 (which is transparent in this embodiment). In particular, in FIG. 22, the contact area 2202 is highlighted.

Figure 23:
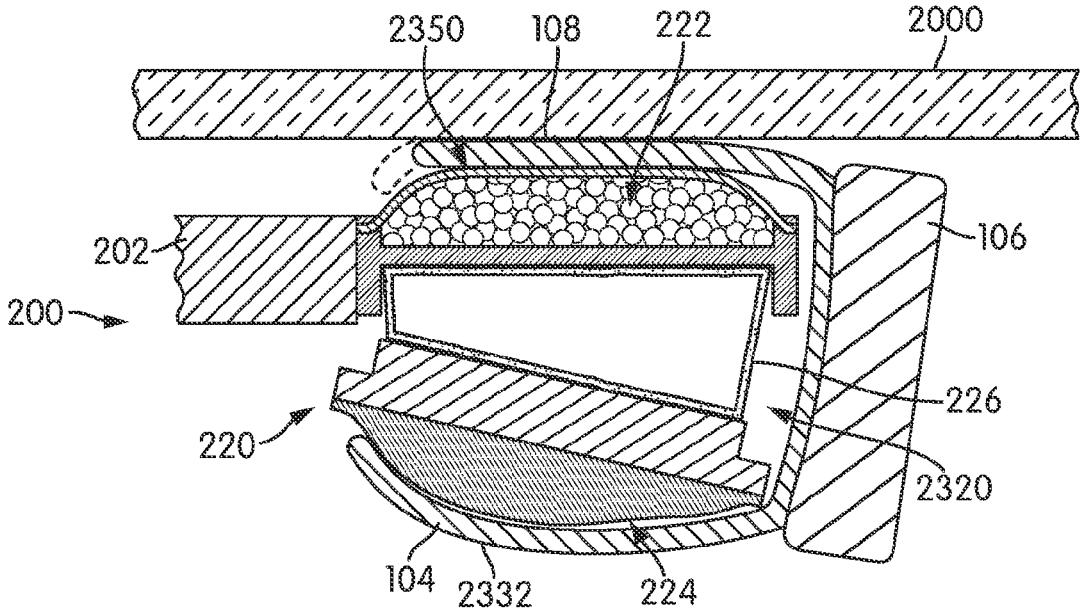
FIG. 23 is a schematic cross-sectional view of an embodiment of an article of footwear mounted to a last portion of a holding assembly, in which the last portion has expanded and adjusted the position of the article of footwear.

In order to facilitate better contact between flattening plate 2000 and upper 104, holding assembly 200 may include provisions to change the position and/or orientation of upper 104 on last portion 220. In some embodiments, as bladder member 226 expands, second side portion 224 may a push against upper 104 and thereby change the orientation of article 102 on last portion 220. Referring to FIG. 23, bladder member 226 has been inflated and expanded, which may tend to push first side portion 222 and second side portion 224 apart. More specifically, second side portion 224 is rotated away from first side portion 222. As second side portion 224 rotates, last portion 220 may expand to fill the interior cavity 2320 of upper 104. Moreover, second side portion 224 may contact medial side portion 2332 of upper 104. As second side portion 224 continues to press against medial side portion 2332, upper 104 may tend to rotate slightly on last portion 220. In particular, lateral side portion 108 of upper 104 may slide further from base portion of holding assembly 202.

As seen in FIG. 23, the position of sole structure 106 may also be adjusted as last portion 220 expands. In some embodiments, the position of sole structure 106 may be tilted downwardly, or away from, flattening plate 2000. In this tilted position, sole structure 106 may be spaced apart from flattening plate 2000. Thus, the expansion of last portion 220 helps to reposition article 102 on last portion 220 such that sole structure 106 is no longer in contact with flattening plate 2000 and such that lateral side portion 108 of upper 104 is in direct contact with flattening plate 2000. This arrangement allows flattening plate 2000 to provide a substantially uniform pressure over the entirety of the region of lateral side portion 108 in contact with flattening plate 2000, thereby facilitating flattening of the desired region.

Figure 24:
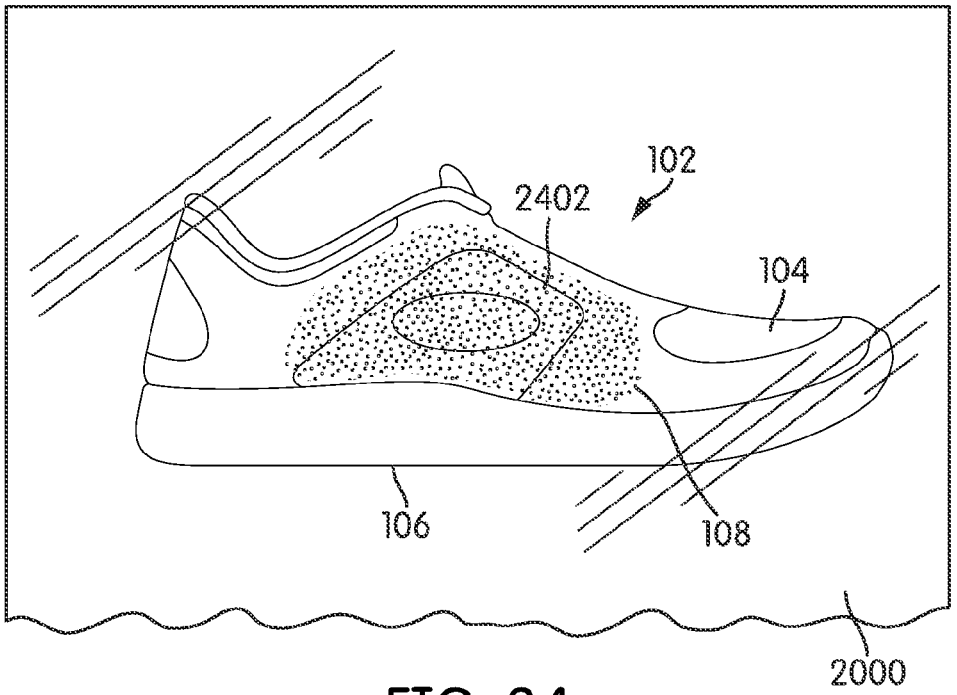
FIG. 24 is a top down schematic view of an embodiment of an article of footwear disposed beneath a flattening plate in which the contact area between the article of footwear and the flattening plate is highlighted.

The area of contact between article 102 and flattening plate 2000 may also be seen in FIG. 24, which shows a top down view of article 102 through flattening plate 2000 (which is transparent in this embodiment). In particular, in FIG. 24, the contact area 2402 is highlighted. Comparing FIG. 22 with FIG. 24 it can be seen that adjusting the orientation of article 102 on last portion 220 helps provide a substantially larger contact area between flattening plate 2000 and lateral side portion 108 of upper 104.

As seen in FIG. 23, first side portion 222 comprises a flexible outer surface 2350 that forms a substantially flat surface as flattening plate 2000 depresses lateral side wall 108 of upper 104. At this stage in the process for preparing article 102 for printing, a vacuum may be introduced to first side portion 222 so that the flattened shape of outer surface 2350 can be maintained even after flattening plate 2000 has been removed.

Figure 25:
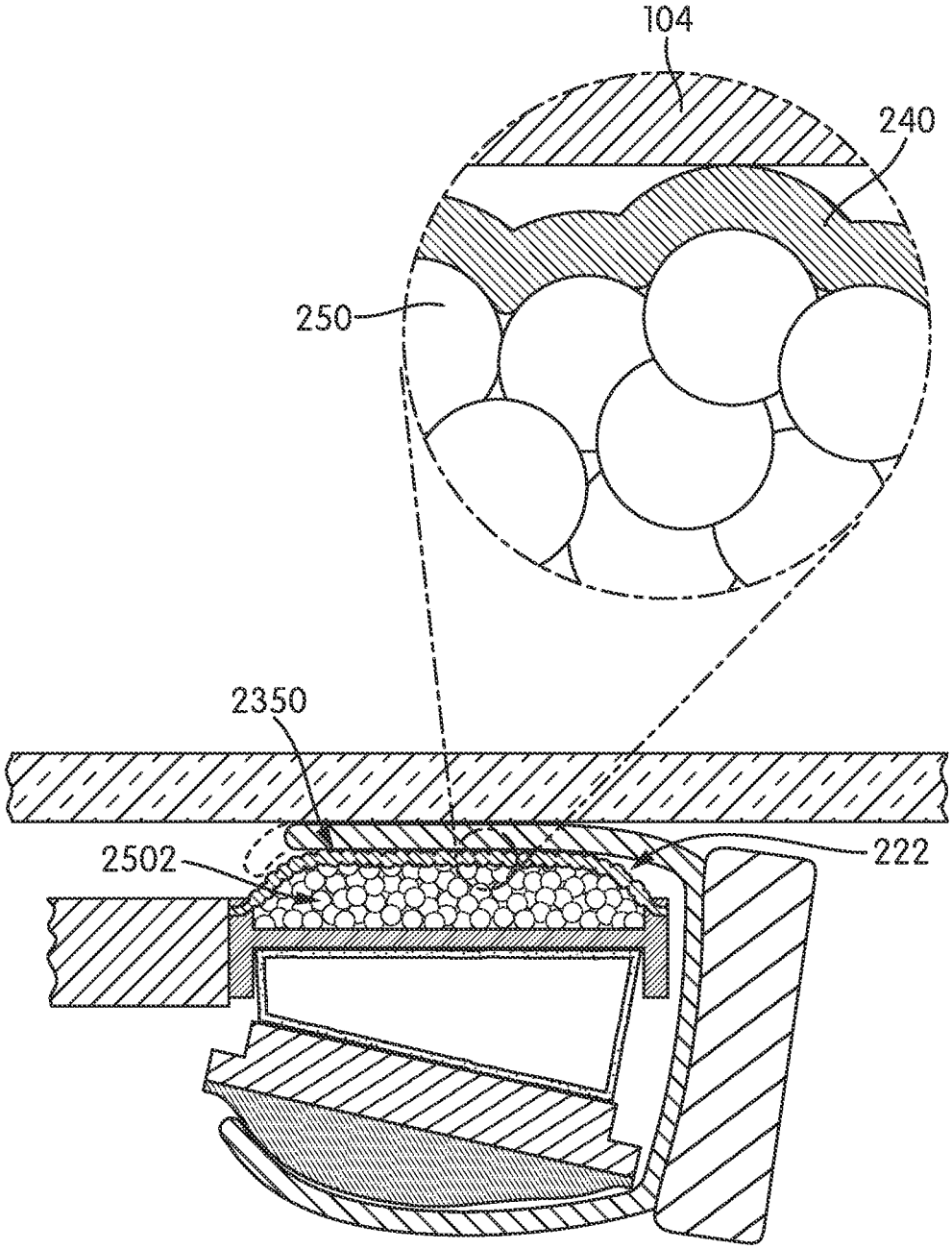
FIG. 25 is a schematic cross-sectional view of an embodiment of an article of footwear mounted to a last portion of a holding assembly, in which a vacuum has been applied to temporarily fix the geometry of an outer surface of the last portion.
Figure 26:
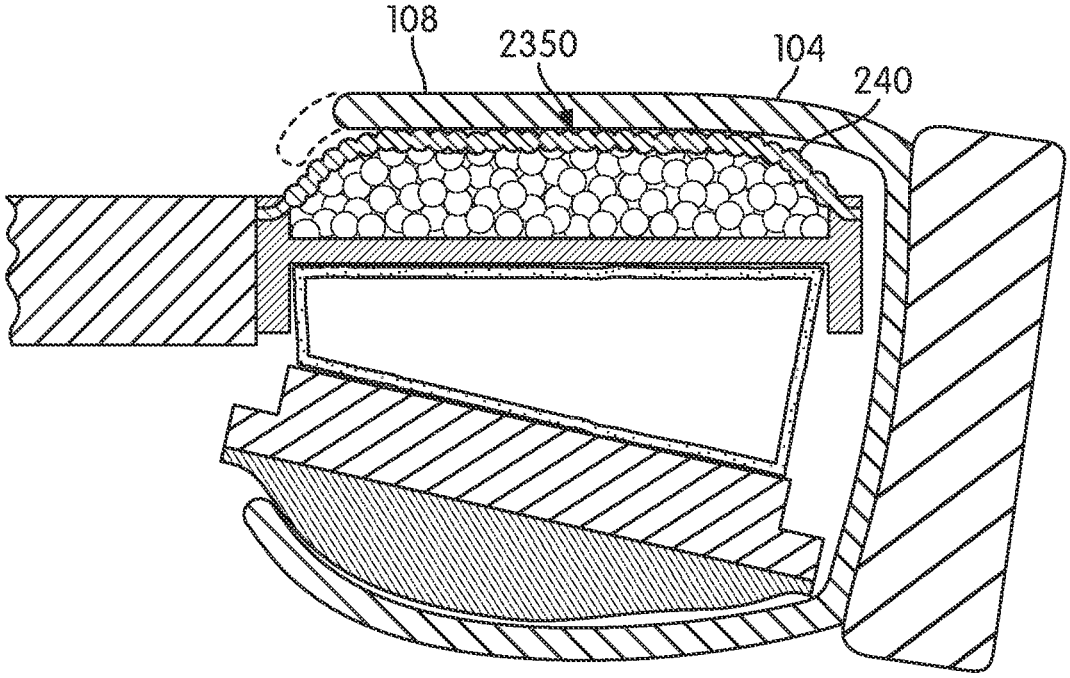
FIG. 26 is a schematic cross-sectional view of an embodiment of an article of footwear mounted to a last portion of a holding assembly, in which a vacuum has been applied to temporarily fix the geometry of an outer surface of the last portion.

Referring now to FIG. 25, fluid (e.g., air) in interior chamber 2502 of first side portion 222 has been removed via fluid communication with a vacuum source, such as a vacuum pump. As previously described, this may cause flexible membrane 240 to be pulled taut against plurality of beads 250 so that the configuration of plurality of beads 250 and the corresponding geometry of outer surface 2350 can be fixed. In other words, a vacuum is used to create a substantially rigid outer surface 2350 that will tend to hold its shape after flattening plate 2000 has been removed. As seen in FIG. 26, with flattening plate 2000 removed, outer surface 2350 maintains a substantially flat shape.

A flexible manufacturing system may include provisions for aligning an article on a platform in a manner that minimizes calibration requirements. In some embodiments, a flexible manufacturing system may include a transparent display device that can be used to precisely align a portion of an article with respect to a printer to ensure a graphic is printed in a desired location.

Figure 27:
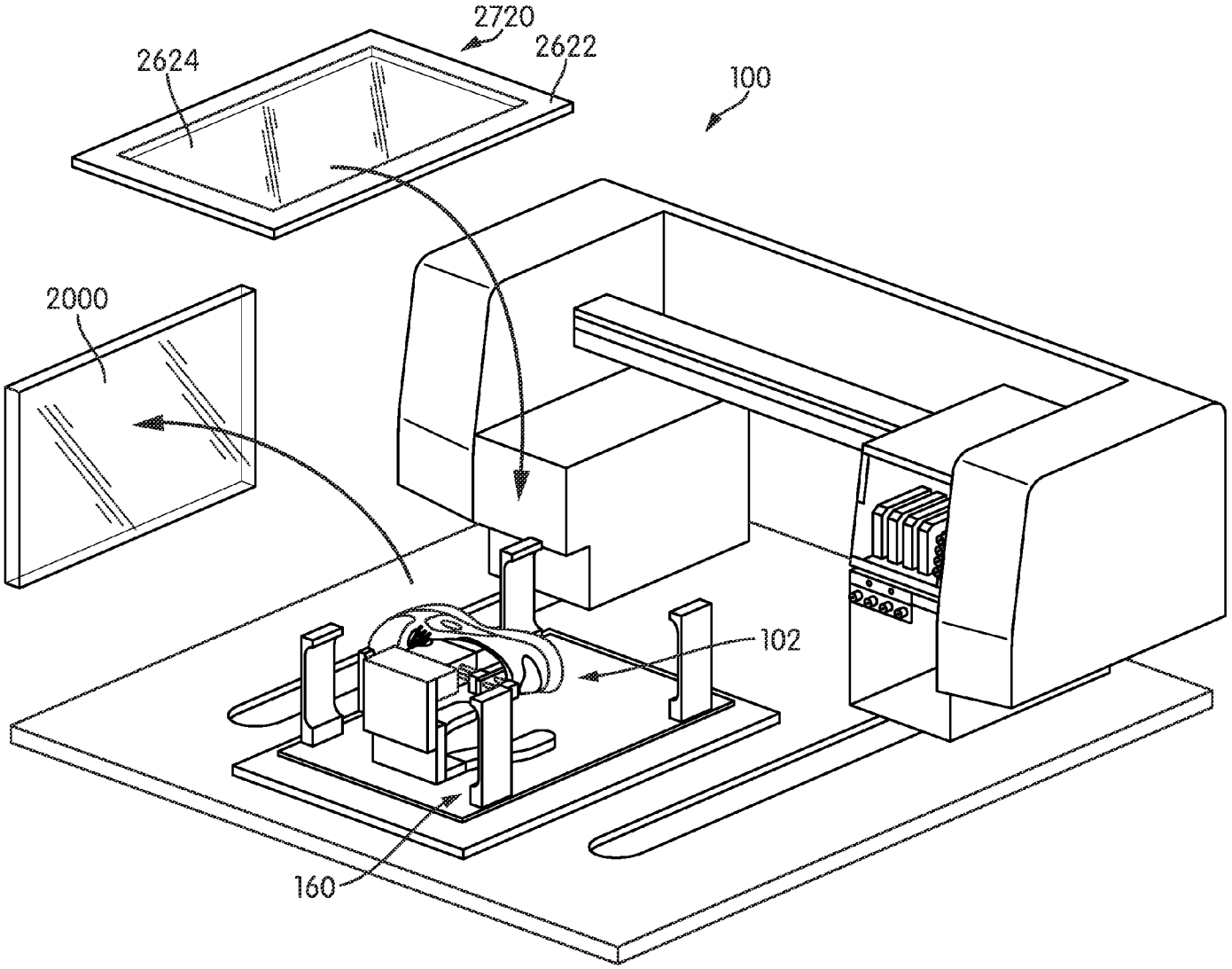
FIG. 27 is a schematic view of an embodiment of a flattening plate being removed from a plurality of mounting arms of a flexible manufacturing system.
Figure 28:
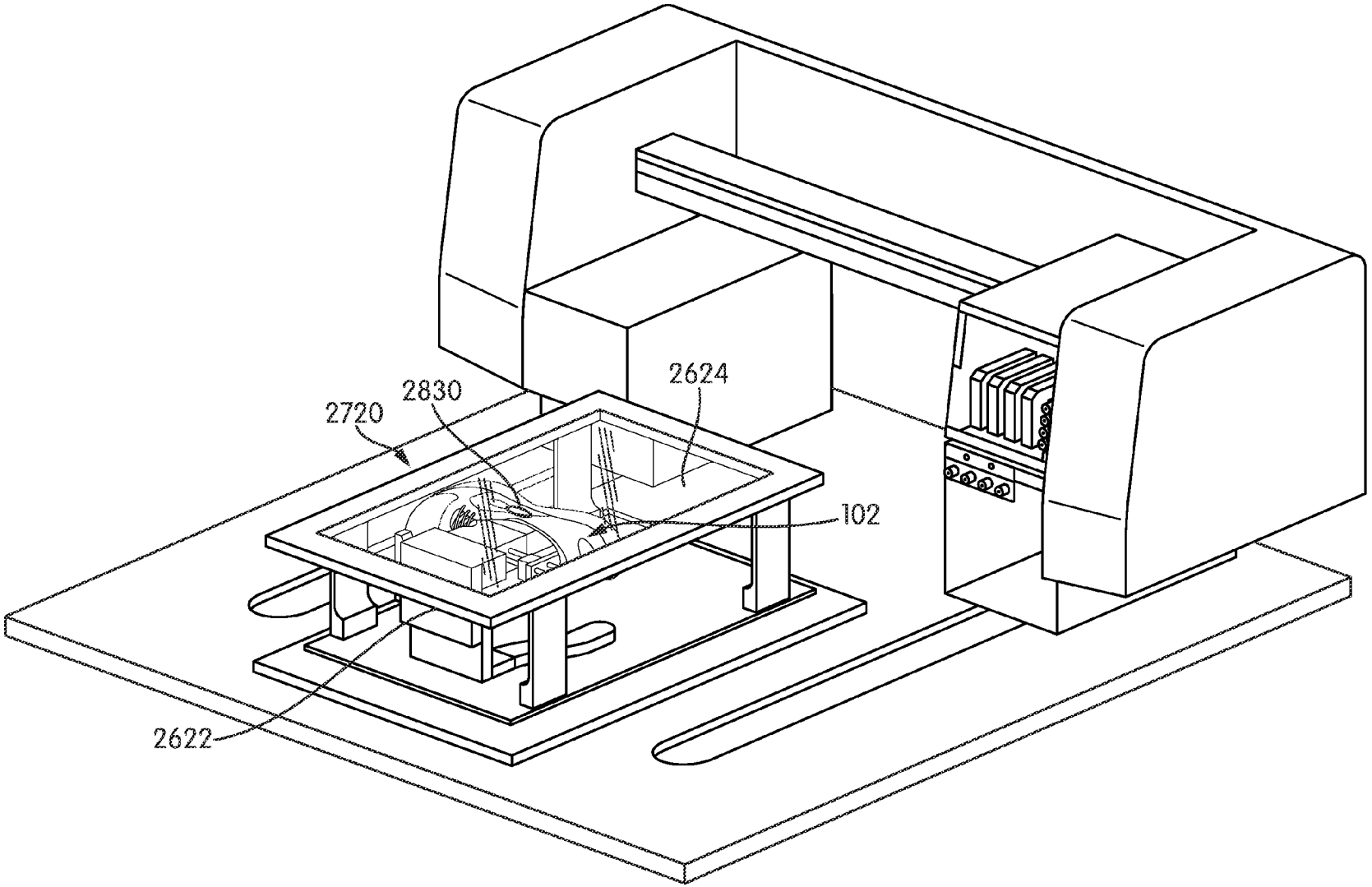
FIG. 28 is a schematic view of an embodiment of a display device mounted to a plurality of mounting arms of a flexible manufacturing system.

FIGS. 27 and 28 illustrate schematic views of flexible manufacturing system 100, in which a transparent a display device is used to align the position and/or orientation of an article for printing. Referring to FIGS. 27 and 28, after the desired portion of article 102 has been flattened in preparation for printing, flattening plate 2000 can be removed from plurality of mounting arms 160. At this point, a display device 2720 may be mounted onto plurality of mounting arms 160. In some embodiments, display device 2720 may communicate with computing system 101 (see FIG. 1) via a wired and/or wireless connection.

Display device 2720 may include an outer frame portion 2622 that houses a screen portion 2624. As seen in FIGS. 27 and 28, in some embodiments, screen portion 2624 is substantially transparent. This allows a viewer to see through screen portion 2624.

Display device 2720 may be further configured to display one or more images on screen portion 2624. In the current embodiment, for example, display device 2720 receives information from computing system 101 (see FIG. 1) and displays graphic 2830 in a central portion of screen portion 2624. This may allow a user to see graphic 2830 superimposed over article 102 when article 102 is viewed through display device 2720. In particular, this arrangement allows a graphic to be superimposed, and therefore aligned, over a portion of an article, in order to align the article for printing. Details of this method are discussed in further detail below.

Display device 2720 may be any kind of device capable of displaying graphics and/or images. Generally, display device 2720 may utilize any display technology capable of displaying images on a transparent or semi-transparent screen. Some embodiments could make use of heads-up-display (HUD) technologies, which display images on a transparent screen using, for example, CRT images on a phosphor screen, optical waveguide technology, scanning lasers for displaying images on transparent screens as well as solid state technologies such as LEDs. Examples of solid state technologies that may be used with display device 2720 include, but are not limited to liquid crystal displays (LCDs), liquid crystal on silicon displays (LCoS), digital micro-mirrors (DMD) as well as various kinds of light emitting diode displays (LEDs), such as organic light emitting diodes (OLEDs). The type of display technology used may be selected according to various factors such as display size, weight, cost, manufacturing constraints (such as space requirements), degree of transparency as well as possibly other factors.

Although some embodiments may use screens that are substantially transparent, other embodiments may use screens that are only partially transparent or translucent. The degree of transparency required may vary according to manufacturing considerations such as lighting conditions, manufacturing costs, and precision tolerances for alignment.

Figure 29:
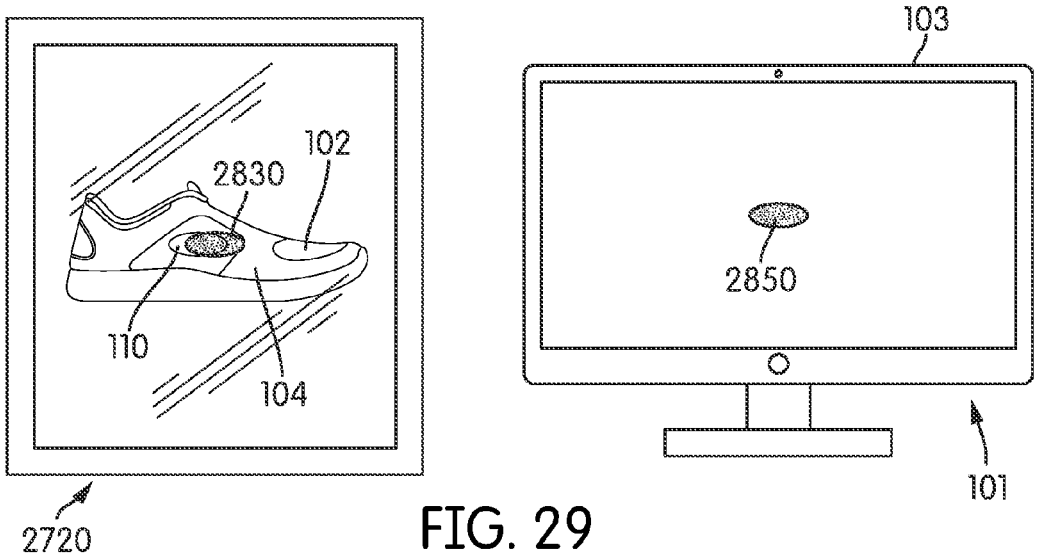
FIG. 29 is a schematic view of a step in a process of aligning an article of footwear for printing using a display device, according to an embodiment.
Figure 30:
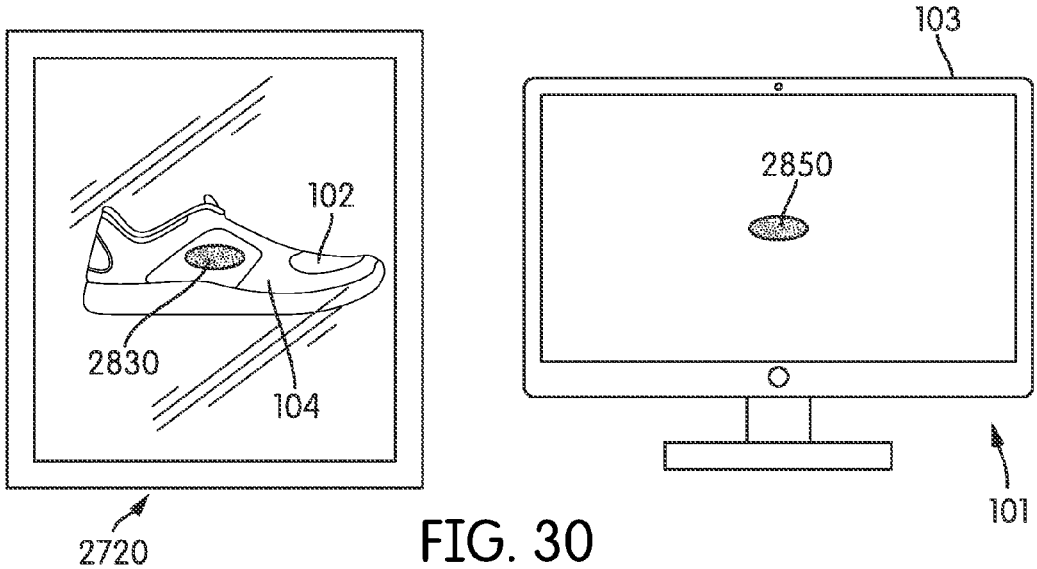
FIG. 30 is a schematic view of a step in a process of aligning an article of footwear for printing using a display device, according to an embodiment.

FIGS. 29 and 30 illustrate an exemplary method for aligning an article with a printer using display device 2720. For purposes of illustration, article 102 is seen beneath display device 2720 in isolation, however it will be understood that article 102 may generally be held in position beneath display device 2720 by holding assembly 200. In the embodiments shown in FIGS. 29 and 30, display device 2720 may display graphic 2830 that is intended to be aligned with design element 110 of article 102. As previously discussed, design element 110 could be a logo or any other kind of design element that is integrated into upper 104. Aligning graphic 2830 over design element 110 ensures that article 102, and especially the region around design element 110, will be correctly aligned with printing system 120.

As seen in FIGS. 29 and 30, graphic 2830 may be generated by computing system 101. In particular, graphic 2830 may be substantially identical to a graphic 2850 displayed on display 103 of computing system 101.

FIGS. 29 and 30 illustrate relative positions of graphic 2830 and design element 110 prior to alignment, and after alignment, respectively. In some embodiments, to align graphic 2830 over the desired location of article 102, a user may move the position of holding assembly 200 and article 102 beneath display device 2720 to achieve the desired alignment between graphic 2830 and design element 110. Thus for example, a user can slide holding assembly 200 and article 102 into the desired relative position as seen in FIG. 30 in order to achieve the desired alignment.

In still other embodiments, the position of graphic 2830 may be adjusted in order to achieve the desired alignment. In such an embodiment, the position of graphic 2830 on display device 2720 may be changed by a user. Generally, the position of graphic 2830 may be changed using any desired technology, including, for example, touch-screen technology. In other words, in some cases a user may touch graphic 2830 on display device 2720 and slide graphic 2830 into the desired location for alignment with design element 110. In other embodiments, a user could adjust the relative location of graphic 2830 on display device 2720 using computing device 101, a remote device or any other method known for controlling the positions of graphics on a display.

Further methods for aligning images on a display device with portions of an article, as well as methods of calibrating a display device and a printing system are disclosed in the alignment and printing case as well as in the printer alignment using remote device case.

In some embodiments, once graphic 2830 has been aligned over design element 110, a user may initiate the process of printing onto the article using printing system 120. As seen in FIG. 31, a user may select a desired graphic 3102 to be printed onto article 102. In this example, graphic 3102 is a lightning bolt that overlaps with graphic 2830. Thus, a user may expect printing system 120 to print graphic 3102 directly onto design element 110.

As seen in FIGS. 32 and 33, the current arrangement facilitates accurate printing by presenting a substantially flat printing surface 3202 on lateral side portion 108 of upper 104. Specifically, the flattened geometry of lateral side portion 108 accomplished using holding assembly 200 better approximates a desired planar printing area than the default curved geometry of lateral side portion 108, which is indicated by phantom curve 3240. Thus, as clearly seen in FIGS. 32 and 33, the flattening of lateral side portion 108 that is accomplished using the provisions discussed above allows printers configured to print in generally 2 dimensions to apply graphics to articles with three dimensional geometries.

The method described here may produce printed graphic 3402 on lateral side portion 108 of article 102, as seen in FIG. 34. Although the current embodiment illustrates printing to lateral side portion 108 of article 102, a similar process could be used to print one or more graphics onto a medial side portion of article 102. Moreover, this method can be utilized to print graphics over any portion of article 102, including the toe portions, midfoot portions and/or heel portions of article 102.

As seen in the figures, first side portion 222 of last portion 220 may be substantially deformable, while second side portion 224 may be substantially rigid. This may facilitate the flattening of the lateral side of an article, which is disposed over first side portion 222. Some embodiments may include a corresponding holding assembly configured for use in flattening the medial side of an article.

Figure 35:
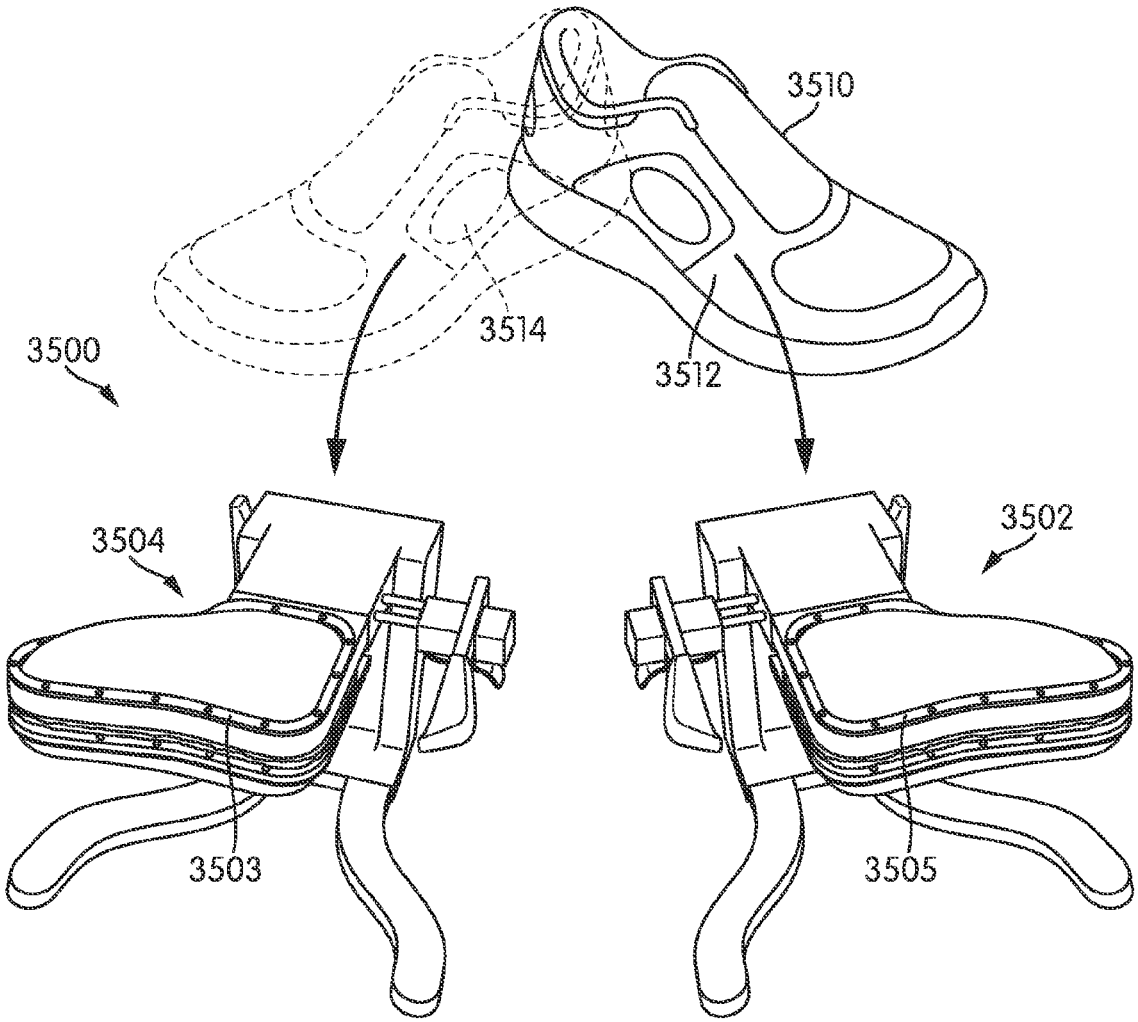
FIG. 35 is a schematic view of an embodiment of two corresponding holding assemblies configured for use with opposing sides of an article of footwear.

FIG. 35 illustrates an embodiment utilizing a pair of corresponding holding assemblies 3500 and a corresponding article 3510. In this embodiment, first holding assembly 3502 may be used for printing onto lateral side 3512 of article 3510. Likewise, second holding assembly 3504 may be used for printing onto medial side 3514 of article 3510. In particular, first holding assembly 3502 includes a last portion 3505 that is oriented in a manner so that when article 3510 is placed onto last portion 3505, lateral side 3512 of article 3510 will face upwards and towards a printing system. Similarly, second holding assembly 3504 includes a last portion 3503 that is oriented in a manner so that when article 3510 is placed onto last portion 3503, medial side 3514 of article 3510 will face upwards and towards a printing system.

The arrangement here allows for printing onto both sides of an article by utilizing a pair of corresponding holding assemblies. It will be further understood that two holding assemblies can be used to print to opposing sides of both left and right articles of footwear.

As previously discussed, a holding assembly may be configured for use with multiple different footwear sizes. In particular, using an adjustable heel assembly to accommodate different lengths of footwear as well as a last portion with a deformable outer surface allows a holding assembly to fit a wide range of different footwear sizes.

Figure 36:
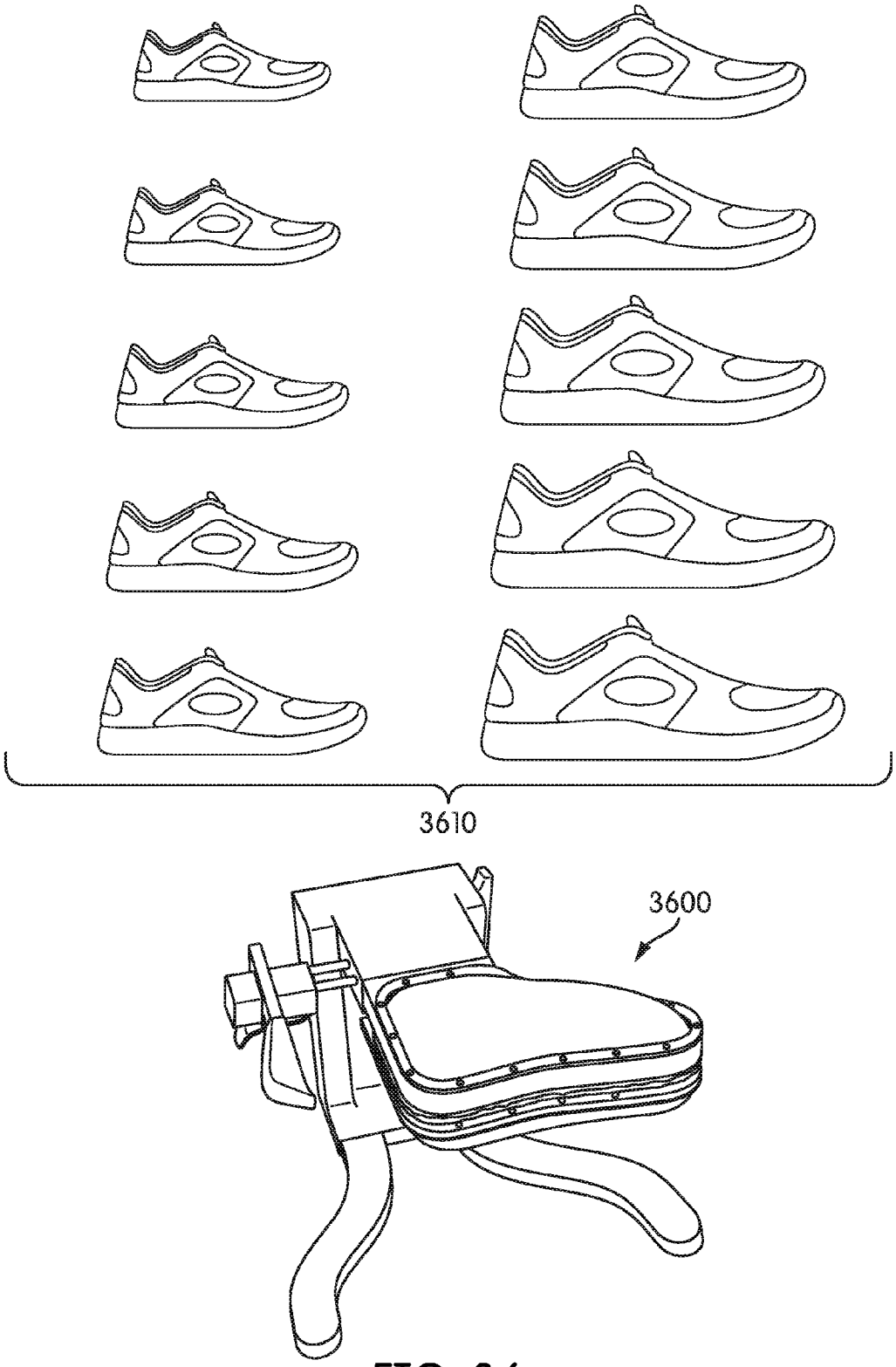
FIG. 36 is a schematic view of a plurality of different shoe sizes that can be used with an embodiment of a holding assembly.

FIG. 36 illustrates a schematic view of a holding assembly 3600 that is configured to accommodate a wide variety of different footwear sizes. In this case, any of plurality of article of footwear sizes 3610 may be accommodated by holding assembly 3600 in order to hold and prepare the article for printing. In this example, ten different footwear sizes are shown, however additional footwear sizes may also be accommodated with holding assembly 3600. In some embodiments, for example, holding assembly 3600 may be used with a range of footwear sizes including all half step sizes between a women's size 5 to a women's size 11, as well as all half step sizes between a men's size 6 to a men's size 15. In still other embodiments, a holding assembly could be configured for use with any other range of footwear sizes, including U.S. men's sizes, U.S. women's sizes, various different international shoe sizes, as well as kid's sizes. In one embodiment, for example, a first holding assembly could be configured for use with all U.S. men's and women's shoe sizes, while a second holding assembly could be configured for use with all kid's sizes.

Figure 37:
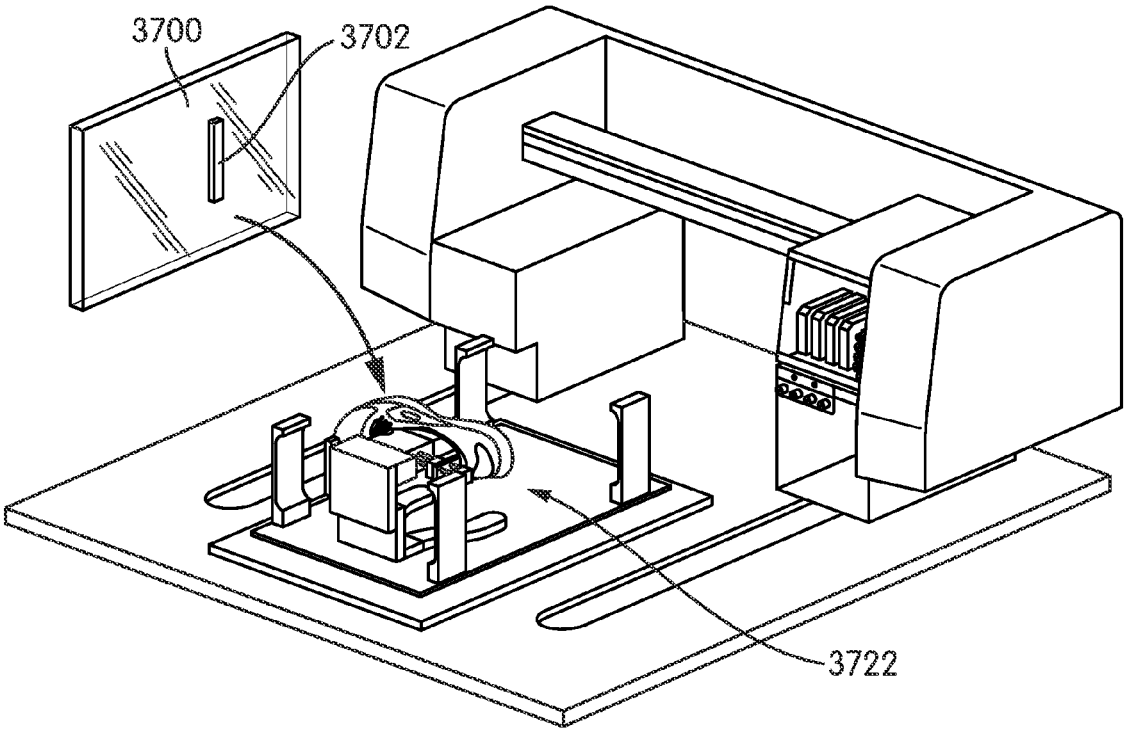
FIG. 37 is a schematic view of an embodiment of a flexible manufacturing system including a flattening plate with a strip member.
Figure 38:
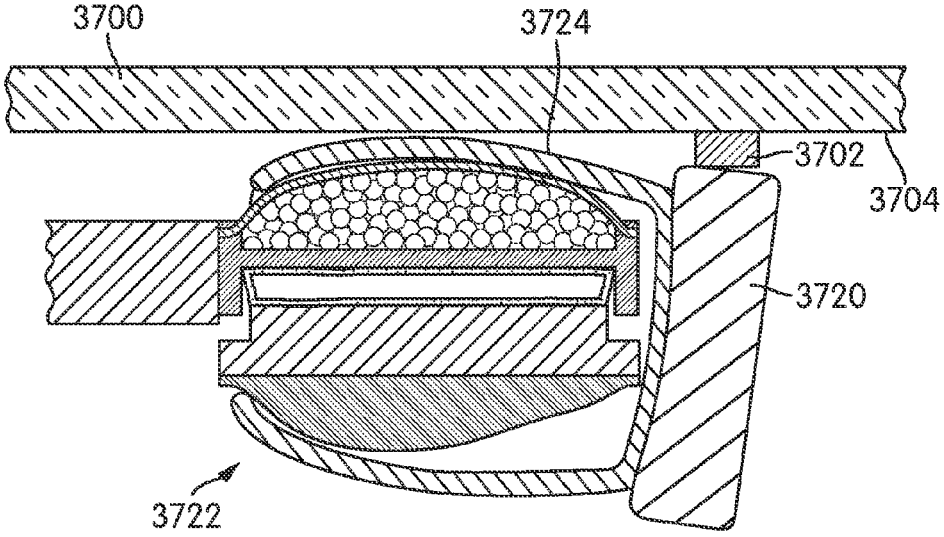
FIG. 38 is a schematic cross-sectional view of an embodiment of a flattening plate with a strip member depressing a sole structure.

Some embodiments can include additional provisions for adjusting the position and/or orientation of an article on a last portion. In another embodiment, shown in FIGS. 37 and 38, a flattening plate 3700 may be configured with a strip member 3702 that is configured to contact a sole structure 3720 of article 3722. As seen in FIG. 38, with flattening plate 3700 in place over article 3722, strip member 3702 may contact sole structure 3720. Moreover, strip member 3702 extends below lower surface 3704 of flattening plate 3700. With this arrangement, strip member 3702 may act to push sole structure 3720 down and away from lower surface 3704. This may help increase the contact area between flattening plate 3700 and upper 3724 of article 3722. In some cases, the contact area may be further increased by expanding last portion 3730 within upper 3724.

Figure 39:
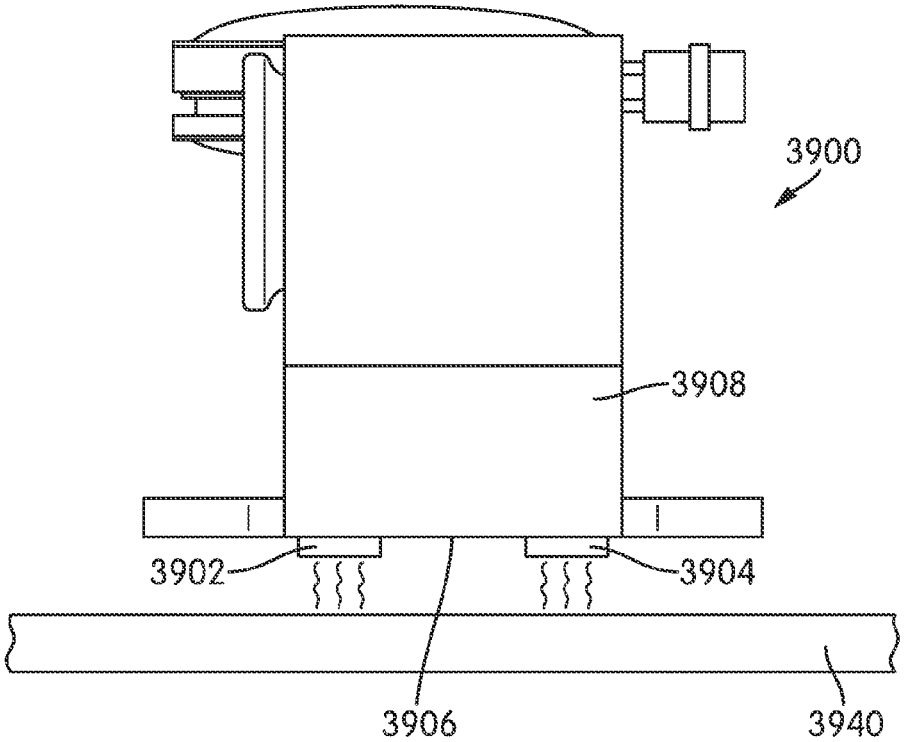
FIG. 39 is a schematic view of an embodiment of a holding assembly that can be temporarily fixed on a platform using magnetism.
Figure 40:
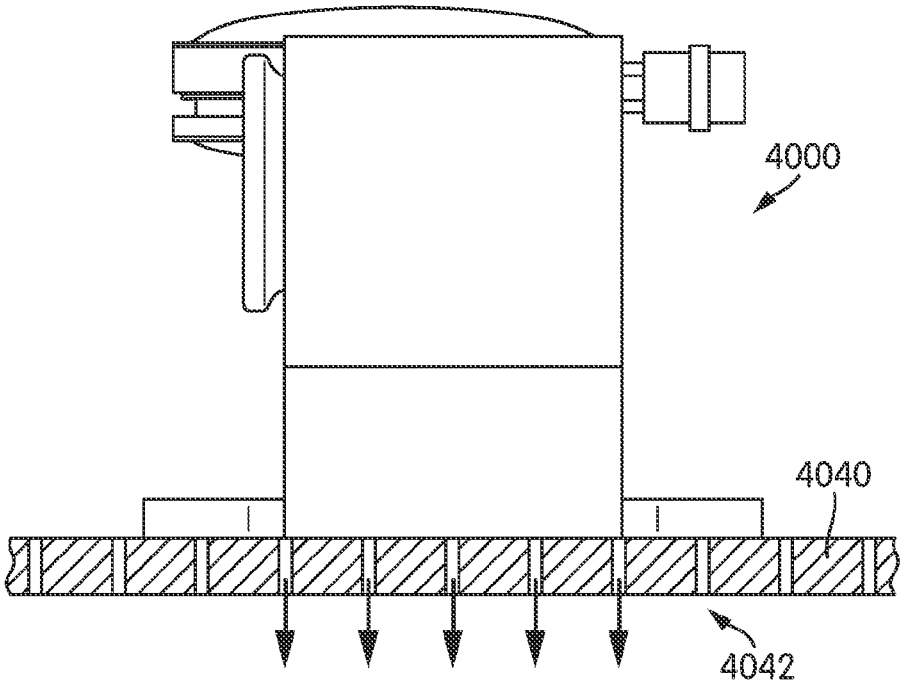
FIG. 40 is a schematic view of an embodiment of a holding assembly that can be temporarily fixed on a platform using a vacuum table.

As previously discussed, a flexible manufacturing system may include provisions for locking or otherwise temporarily securing a holding assembly in place after the holding assembly has been placed on a platform in preparation for printing. FIGS. 39 and 40 illustrate schematic views of various methods for locking the position of a holding assembly in place on a platform. Referring first to FIG. 39, some embodiments may include magnetic provisions that help to lock the position of a holding assembly 3900 in place on platform 3940. For example, in the embodiment of FIG. 39, holding assembly 3900 may include first magnetic strip 3902 and second magnetic strip 3904 on a bottom surface 3906 of base portion 3908. In embodiments where platform 3940 is susceptible to magnetic forces, first magnetic strip 3902 and second magnetic strip 3904 may help keep holding assembly 3900 locked in a particular position on platform 3940. In still other embodiments, one of a holding assembly or corresponding platform could be configured with a magnetic paint.

FIG. 40 illustrates still another embodiment in which holding assembly 4000 is held in position using suction (i.e., a vacuum). In particular, in this embodiment platform 4040 is configured with a plurality of vacuum holes 4042 that pull a vacuum. The vacuum may act to pull holding assembly 4000 towards platform 4040 and prevent horizontal movement of holding assembly 4000 along platform 4040.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A method of printing to an upper of an article of footwear, comprising:

placing the article of footwear onto a last portion of a holding assembly, the last portion including a first side portion filled with a plurality of bead members and further having a flexible membrane stretched over the plurality of bead members;

flattening a side portion of the upper and the first side portion of the last portion;

creating a vacuum within an interior cavity of the first side portion so that the flexible membrane and the plurality of bead members have a substantially rigid geometry; and printing onto the side portion of the upper.

2. The method according to claim 1, wherein flattening the side portion of the upper includes associating a flattening plate with the side portion.

3. The method according to claim 2, wherein the side portion is squeezed between the flattening plate and the first side portion of the last portion.

4. The method according to claim 1, wherein the last portion includes a second side portion and a bladder member disposed between the first side portion and the second side portion.

5. The method according to claim 4, wherein flattening the side portion is followed by expanding the bladder member so that the first side portion and the second side portion are separated.

6. The method according to claim 3, wherein the flattening plate is removed before printing onto the side portion of the upper.

7. A method of printing to an upper of an article of footwear, comprising:

placing the article of footwear onto a last portion of a holding assembly, the last portion including a first side portion and a second side portion connected via a bladder member;

inflating the bladder member so that the last portion expands and causes the article of footwear to tilt on the last portion;

flattening a side portion of the upper; and printing onto the side portion of the upper.

8. The method according to claim 7, wherein flattening the side portion of the upper includes placing a flattening plate against the upper.

9. The method according to claim 7, wherein the first side portion includes a flexible membrane that bounds an interior chamber filled with a plurality of bead members.

10. The method according to claim 9, wherein flattening the side portion of the upper is followed by creating a vacuum within the interior chamber, thereby temporarily increasing the rigidity of the flexible membrane.

11. The method according to claim 7, wherein printing onto the side portion of the upper is accomplished using an inkjet printer.

12. The method according to claim 7, wherein inflating the bladder member causes the second side portion to tilt with respect to the first side portion.

13. The method according to claim 7, wherein the holding assembly is configured to hold the article so that the side portion faces a print head of the printer.

14. A method of printing to an upper of an article of footwear, comprising:

placing the article of footwear onto a last portion of a holding assembly, the last portion including a first side portion with an outer surface that is substantially deformable and the last portion including a second side portion;

placing the holding assembly with the article of footwear on a platform;

fastening a flattening plate to a plurality of mounting arms such that the flattening plate contacts the article of footwear;

repositioning the upper on the last portion so that the contact area between the flattening plate and the upper increases;

temporarily increasing the rigidity of the outer surface of the first side portion;

removing the flattening plate; and printing onto the upper.

15. The method according to claim 14, wherein printing onto the upper includes associating a printing system with the article of footwear.

16. The method according to claim 14, wherein placing the holding assembly on the platform further includes temporarily fixing the position of the holding assembly on the platform.

17. The method according to claim 16, wherein magnetism is used to temporarily lock the position of the holding assembly on the platform.

18. The method according to claim 16, wherein a vacuum is used to temporarily lock the position of the holding assembly on the platform.

19. The method according to claim 14, wherein repositioning the upper on the last portion further includes adjusting the separation between the first side portion and the second side portion.

20. The method according to claim 19, wherein separating the first side portion and the second side portion is accomplished by inflating a bladder member, wherein the bladder member is disposed between the first side portion and the second side portion.

* * * * *